US010571205B2

(12) United States Patent
Higashiiue et al.

(10) Patent No.: US 10,571,205 B2
(45) Date of Patent: Feb. 25, 2020

(54) STACKING-TYPE HEADER, HEAT EXCHANGER, AND AIR-CONDITIONING APPARATUS

(71) Applicant: Mitsubishi Electric Corporation, Tokyo (JP)

(72) Inventors: Shinya Higashiiue, Tokyo (JP); Takashi Okazaki, Tokyo (JP); Akira Ishibashi, Tokyo (JP); Daisuke Ito, Tokyo (JP); Takuya Matsuda, Tokyo (JP); Shigeyoshi Matsui, Tokyo (JP); Atsushi Mochizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 84 days.

(21) Appl. No.: 15/941,412

(22) Filed: Mar. 30, 2018

(65) Prior Publication Data

US 2018/0224220 A1 Aug. 9, 2018

Related U.S. Application Data

(62) Division of application No. 14/786,595, filed as application No. PCT/JP2013/063606 on May 15, 2013, now abandoned.

(51) Int. Cl.
*F28F 9/02* (2006.01)
*F28D 1/047* (2006.01)
(Continued)

(52) U.S. Cl.
CPC ..... *F28F 9/0278* (2013.01); *F25B 39/00* (2013.01); *F28D 1/0476* (2013.01);
(Continued)

(58) Field of Classification Search
CPC ..... F28F 9/0278; F28F 9/02; F28F 9/0221; F28D 2021/0071; F28D 2021/007
See application file for complete search history.

(56) References Cited

U.S. PATENT DOCUMENTS 5,050,671 A * 9/1991 Fletcher ..... F28D 1/0308 165/148
5,241,839 A 9/1993 Hughes
(Continued)

FOREIGN PATENT DOCUMENTS

JP 06-011291 A 1/1994
JP 11-101591 A 4/1999
(Continued)

OTHER PUBLICATIONS

International Search Report of the International Searching Authority dated Jul. 23, 2013 for the corresponding international application No. PCT/JP2013/063606 (and English translation).
(Continued)

*Primary Examiner* — Kun Kai Ma
(74) *Attorney, Agent, or Firm* — Posz Law Group, PLC

(57) ABSTRACT

A stacking-type header according to the present invention includes: a first plate-shaped unit; and a second plate-shaped unit stacked on the first plate-shaped unit, and having a distribution flow passage, in which the distribution flow passage includes a branching flow passage including: a first flow passage; and a second flow passage, and in which the branching flow passage is smaller in difference in flow resistance between the first flow passage and the second flow passage than a branching flow passage in a state in which a flow-passage resistance in the first flow passage and a flow-passage resistance in the second flow passage are equal
(Continued)

to each other, and in a state in which the first flow passage and the second flow passage are point symmetric with each other about the opening port.

11 Claims, 15 Drawing Sheets

(51) Int. Cl.
*F28D 1/053* (2006.01)
*F25B 39/00* (2006.01)
*F28D 21/00* (2006.01)

(52) U.S. Cl.
CPC ..... *F28D 1/05333* (2013.01); *F28F 9/02* (2013.01); *F28F 9/0221* (2013.01); *F28D 2021/007* (2013.01); *F28D 2021/0071* (2013.01)

(56) References Cited

U.S. PATENT DOCUMENTS 5,242,016 A * 9/1993 Voss ..... F25B 39/028 165/173
6,892,805 B1 5/2005 Valensa
2003/0079863 A1* 5/2003 Sugito ..... F28D 15/0266 165/104.21
2003/0188857 A1* 10/2003 Kawakubo ..... F28D 1/0476 165/174
2005/0039901 A1* 2/2005 Demuth ..... F28D 1/0478 165/175
2007/0251682 A1 11/2007 Sasaki
2013/0174924 A1 7/2013 Luo et al.

FOREIGN PATENT DOCUMENTS

JP 2000-161818 A 6/2000
JP 2007-298197 A 11/2007
JP 2010-139114 A 6/2010

OTHER PUBLICATIONS

Office Action dated Nov. 15, 2016 issued in corresponding CN patent application No. 201380076563.2 (and English translation).
Office Action dated Feb. 21, 2017 issued in corresponding JP patent application No. 2015-516826 (and English translation).
Extended European search report dated Jun. 28, 2017 in the corresponding EP patent application No. 13884403.0.
Office Action dated Aug. 9, 2016 issued in corresponding JP patent application No. 2015-516826 (and English translation).

* cited by examiner

STACKING-TYPE HEADER, HEAT EXCHANGER, AND AIR-CONDITIONING APPARATUS

CROSS REFERENCE TO RELATED APPLICATIONS

The present application is a divisional application of U.S. application Ser. No. 14/786,595 filed on Oct. 23, 2015, which is a U.S. national stage application of International Patent Application No. PCT/JP2013/063606 filed on May 15, 2013, the contents of which are incorporated herein by reference.

TECHNICAL FIELD

The present invention relates to a stacking-type header, a heat exchanger, and an air-conditioning apparatus.

BACKGROUND ART

As a related-art stacking-type header, there is known a stacking-type header including a first plate-shaped unit having a plurality of outlet flow passages formed therein, and a second plate-shaped unit stacked on the first plate-shaped unit and having a distribution flow passage formed therein, for distributing refrigerant, which passes through an inlet flow passage to flow into the second plate-shaped unit, to the plurality of outlet flow passages formed in the first plate-shaped unit to cause the refrigerant to flow out from the second plate-shaped unit. The distribution flow passage includes a branching flow passage having a plurality of grooves extending perpendicular to a refrigerant inflow direction. The refrigerant passing through the inlet flow passage passes through the plurality of grooves to be branched into a plurality of flows, to thereby pass through the plurality of outlet flow passages formed in the first plate-shaped unit to flow out from the first plate-shaped unit (for example, see Patent Literature 1).

CITATION LIST

Patent Literature

Patent Literature 1: Japanese Unexamined Patent Application Publication No. 2000-161818 (paragraph [0012] to paragraph [0020], FIG. 1, FIG. 2)

SUMMARY OF INVENTION

Technical Problem

In such a stacking-type header, when the stacking-type header is used under a state in which the inflow direction of the refrigerant flowing into the branching flow passage is not parallel to the gravity direction, the refrigerant may be affected by the gravity to cause a deficiency or an excess of the refrigerant in any of the branching directions. In other words, the related-art stacking-type header has a problem in that the uniformity in distribution of the refrigerant is low.

The present invention has been made in view of the above-mentioned problems, and has an object to provide a stacking-type header improved in uniformity in distribution of refrigerant. Further, the present invention has an object to provide a heat exchanger improved in uniformity in distribution of refrigerant. Further, the present invention has an object to provide an air-conditioning apparatus improved in uniformity in distribution of refrigerant.

Solution to Problem

According to one embodiment of the present invention, there is provided a stacking-type header, including: a first plate-shaped unit having a plurality of first outlet flow passages formed therein; and a second plate-shaped unit stacked on the first plate-shaped unit, the second plate-shaped unit having a distribution flow passage formed therein, the distribution flow passage being configured to distribute refrigerant, which passes through a first inlet flow passage to flow into the second plate-shaped unit, to the plurality of first outlet flow passages to cause the refrigerant to flow out from the second plate-shaped unit, in which the distribution flow passage includes a branching flow passage including: an opening port configured to allow the refrigerant to flow thereinto; a first flow passage communicating between the opening port and an end portion positioned on an upper side relative to the opening port; and a second flow passage communicating between the opening port and an end portion positioned on a lower side relative to the opening port, and in which the branching flow passage is smaller in difference in flow resistance between the first flow passage and the second flow passage than a branching flow passage in a state in which a flow-passage resistance in the first flow passage and a flow-passage resistance in the second flow passage are equal to each other, and in a state in which the first flow passage and the second flow passage are point symmetric with each other about the opening port.

Advantageous Effects of Invention

In the stacking-type header according to the one embodiment of the present invention, the distribution flow passage includes the branching flow passage including: the opening port configured to allow the refrigerant to flow thereinto; the first flow passage communicating between the opening port and the end portion positioned on the upper side relative to the opening port; and the second flow passage communicating between the opening port and the end portion positioned on the lower side relative to the opening port, and the branching flow passage is smaller in difference in flow resistance between the first flow passage and the second flow passage than the branching flow passage in a state in which the flow-passage resistance in the first flow passage and the flow-passage resistance in the second flow passage are equal to each other, and in a state in which the first flow passage and the second flow passage are point symmetric with each other about the opening port. When the flow-passage resistances of the first flow passage and the second flow passage are equal to each other, and the first flow passage and the second flow passage are point symmetric with each other about the opening port, the refrigerant passing through the first flow passage and the refrigerant passing through the second flow passage flow out at heights different from each other, with the result that the flow resistance of the first flow passage is larger than the flow resistance of the second flow passage so that a flow rate of the refrigerant that passes through the first flow passage to flow out is smaller than a flow rate of the refrigerant that passes through the second flow passage to flow out. This phenomenon is suppressed in the stacking-type header according to the one embodiment of the present invention, and thus, the uniformity in distribution of the refrigerant is improved.

DESCRIPTION OF EMBODIMENTS

Figure 1:
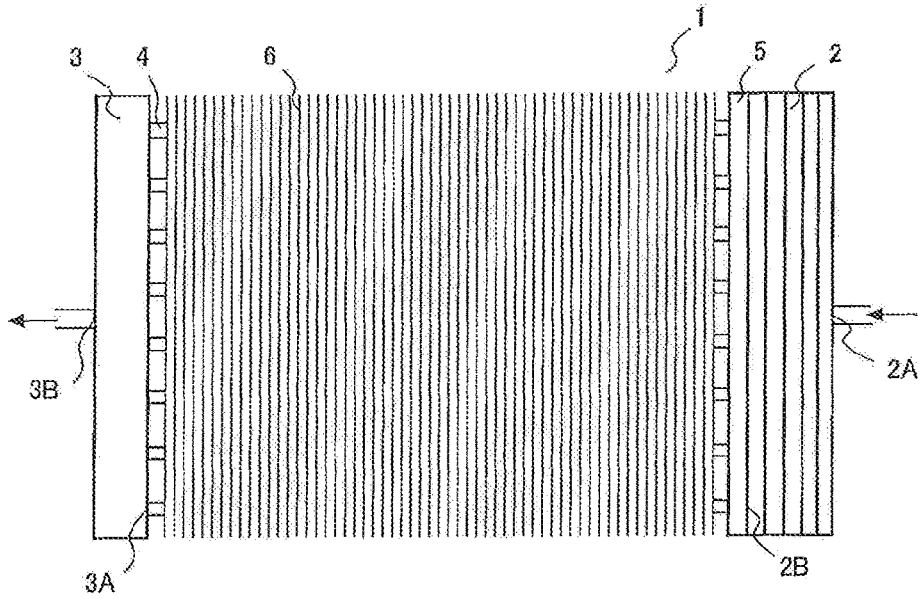
FIG. 1 is a view illustrating a configuration of a heat exchanger according to Embodiment 1.

Now, a stacking-type header according to the present invention is described with reference to the drawings.

Note that, in the following, there is described a case where the stacking-type header according to the present invention distributes refrigerant flowing into a heat exchanger, but the stacking-type header according to the present invention may distribute refrigerant flowing into other devices. Further, the configuration, operation, and other matters described below are merely examples, and the present invention is not limited to such configuration, operation, and other matters. Further, in the drawings, the same or similar components are denoted by the same reference symbols, or the reference symbols therefor are omitted. Further, the illustration of details in the structure is appropriately simplified or omitted. Further, overlapping description or similar description is appropriately simplified or omitted.

Further, in the present invention, a resistance to act on refrigerant passing through a flow passage is generally defined as a "flow resistance", and an element of the "flow resistance", which is derived from characteristics of the flow passage (such as a shape and a surface property), is defined as a "flow-passage resistance".

Embodiment 1

A heat exchanger according to Embodiment 1 is described.

<Configuration of Heat Exchanger>

Now, the configuration of the heat exchanger according to Embodiment 1 is described.

FIG. 1 is a view illustrating the configuration of the heat exchanger according to Embodiment 1.

As illustrated in FIG. 1, a heat exchanger 1 includes a stacking-type header 2, a header 3, a plurality of first heat transfer tubes 4, a retaining member 5, and a plurality of fins 6.

The stacking-type header 2 includes a refrigerant inflow port 2A and a plurality of refrigerant outflow ports 2B. The header 3 includes a plurality of refrigerant inflow ports 3A and a refrigerant outflow port 3B. Refrigerant pipes are connected to the refrigerant inflow port 2A of the stacking-type header 2 and the refrigerant outflow port 3B of the header 3. The plurality of first heat transfer tubes 4 are connected between the plurality of refrigerant outflow ports 2B of the stacking-type header 2 and the plurality of refrigerant inflow ports 3A of the header 3.

The first heat transfer tube 4 is a flat tube having a plurality of flow passages formed therein. The first heat transfer tube 4 is made of, for example, aluminum. End portions of the plurality of first heat transfer tubes 4 on the stacking-type header 2 side are connected to the plurality of refrigerant outflow ports 2B of the stacking-type header 2 under a state in which the end portions are retained by the plate-shaped retaining member 5. The retaining member 5 is made of, for example, aluminum. The plurality of fins 6 are joined to the first heat transfer tubes 4. The fin 6 is made of, for example, aluminum. It is preferred that the first heat transfer tubes 4 and the fins 6 be joined by brazing. Note that, in FIG. 1, there is illustrated a case where eight first heat transfer tubes 4 are provided, but the present invention is not limited to such a case.

<Flow of Refrigerant in Heat Exchanger>

Now, the flow of the refrigerant in the heat exchanger according to Embodiment 1 is described.

The refrigerant flowing through the refrigerant pipe passes through the refrigerant inflow port 2A to flow into the stacking-type header 2 to be distributed, and then passes through the plurality of refrigerant outflow ports 2B to flow out toward the plurality of first heat transfer tubes 4. In the plurality of first heat transfer tubes 4, the refrigerant exchanges heat with air supplied by a fan, for example. The refrigerant flowing through the plurality of first heat transfer tubes 4 passes through the plurality of refrigerant inflow ports 3A to flow into the header 3 to be joined, and then passes through the refrigerant outflow port 3B to flow out toward the refrigerant pipe. The refrigerant can reversely flow.

<Configuration of Laminated Header>

Now, the configuration of the stacking-type header of the heat exchanger according to Embodiment 1 is described.

Figure 2:
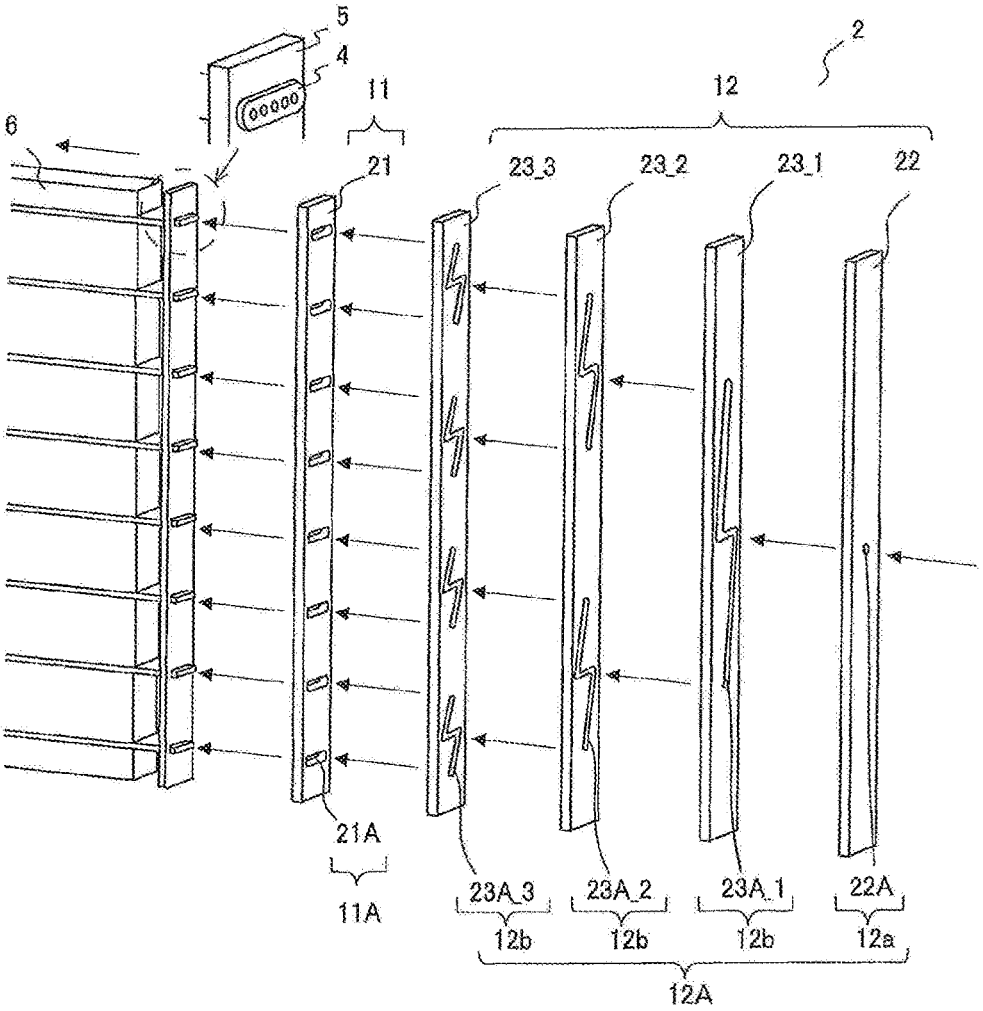
FIG. 2 is a perspective view illustrating the heat exchanger according to Embodiment 1 under a state in which a stacking-type header is disassembled.

FIG. 2 is a perspective view of the heat exchanger according to Embodiment 1 under a state in which the stacking-type header is disassembled.

As illustrated in FIG. 2, the stacking-type header 2 includes a first plate-shaped unit 11 and a second plate-shaped unit 12. The first plate-shaped unit 11 and the second plate-shaped unit 12 are stacked on each other.

The first plate-shaped unit 11 is stacked on the refrigerant outflow side. The first plate-shaped unit 11 includes a first plate-shaped member 21. The first plate-shaped unit 11 has a plurality of first outlet flow passages 11A formed therein. The plurality of first outlet flow passages 11A correspond to the plurality of refrigerant outflow ports 2B in FIG. 1.

The first plate-shaped member 21 has a plurality of flow passages 21A formed therein. The plurality of flow passages 21A are each a through hole having an inner peripheral surface shaped conforming to an outer peripheral surface of the first heat transfer tube 4. When the first plate-shaped member 21 is stacked, the plurality of flow passages 21A function as the plurality of first outlet flow passages 11A. The first plate-shaped member 21 has a thickness of about 1 mm to 10 mm, and is made of aluminum, for example. When the plurality of flow passages 21A are formed by press working or other processing, the work is simplified, and the manufacturing cost is reduced.

The end portions of the first heat transfer tubes 4 are projected from the surface of the retaining member 5. When the first plate-shaped unit 11 is stacked on the retaining member 5 so that the inner peripheral surfaces of the first outlet flow passages 11A are fitted to the outer peripheral surfaces of the respective end portions of the first heat transfer tubes 4, the first heat transfer tubes 4 are connected to the first outlet flow passages 11A. The first outlet flow passages 11A and the first heat transfer tubes 4 may be positioned through, for example, fitting between a convex portion formed in the retaining member 5 and a concave portion formed in the first plate-shaped unit 11. In such a case, the end portions of the first heat transfer tubes 4 may not be projected from the surface of the retaining member 5. The retaining member 5 may be omitted so that the first heat transfer tubes 4 are directly connected to the first outlet flow passages 11A. In such a case, the component cost and the like are reduced.

The second plate-shaped unit 12 is stacked on the refrigerant inflow side. The second plate-shaped unit 12 includes a second plate-shaped member 22 and a plurality of third plate-shaped members 23_1 to 23_3. The second plate-shaped unit 12 has a distribution flow passage 12A formed therein. The distribution flow passage 12A includes a first inlet flow passage 12*a* and a plurality of branching flow passages 12*b*. The first inlet flow passage 12*a* corresponds to the refrigerant inflow port 2A in FIG. 1.

The second plate-shaped member 22 has a flow passage 22A formed therein. The flow passage 22A is a circular through hole. When the second plate-shaped member 22 is stacked, the flow passage 22A functions as the first inlet flow passage 12*a*. The second plate-shaped member 22 has a thickness of about 1 mm to 10 mm, and is made of aluminum, for example. When the flow passage 22A is formed by press working or other processing, the work is simplified, and the manufacturing cost and the like are reduced.

For example, a fitting or other such component is provided on the surface of the second plate-shaped member 22 on the refrigerant inflow side, and the refrigerant pipe is connected to the first inlet flow passage 12*a* through the fitting or other such component. The inner peripheral surface of the first inlet flow passage 12*a* may be shaped to be fitted to the outer peripheral surface of the refrigerant pipe so that the refrigerant pipe may be directly connected to the first inlet flow passage 12*a* without using the fitting or other such component. In such a case, the component cost and the like are reduced.

The plurality of third plate-shaped members 23_1 to 23_3 respectively have a plurality of flow passages 23A_1 to 23A_3 formed therein. The plurality of flow passages 23A_1 to 23A_3 are each a through groove. The plurality of flow passages 23A_1 to 23A_3 are described in detail later. When the plurality of third plate-shaped members 23_1 to 23_3 are stacked, each of the plurality of flow passages 23A_1 to 23A_3 functions as the branching flow passage 12*b*. The plurality of third plate-shaped members 23_1 to 23_3 each have a thickness of about 1 mm to 10 mm, and are made of aluminum, for example. When the plurality of flow passages 23A_1 to 23A_3 are formed by press working or other processing, the work is simplified, and the manufacturing cost and the like are reduced.

In the following, in some cases, the plurality of third plate-shaped members 23_1 to 23_3 are collectively referred to as the third plate-shaped member 23. In the following, in some cases, the plurality of flow passages 23A_1 to 23A_3 are collectively referred to as the flow passage 23A. In the following, in some cases, the retaining member 5, the first plate-shaped member 21, the second plate-shaped member 22, and the third plate-shaped member 23 are collectively referred to as the plate-shaped member.

The branching flow passage 12*b* branches the refrigerant flowing therein into two flows to cause the refrigerant to flow out therefrom. Therefore, when the number of the first heat transfer tubes 4 to be connected is eight, at least three third plate-shaped members 23 are required. When the number of the first heat transfer tubes 4 to be connected is sixteen, at least four third plate-shaped members 23 are required. The number of the first heat transfer tubes 4 to be connected is not limited to powers of 2. In such a case, the branching flow passage 12*b* and a non-branching flow passage may be combined with each other. Note that, the number of the first heat transfer tubes 4 to be connected may be two.

Figure 3:
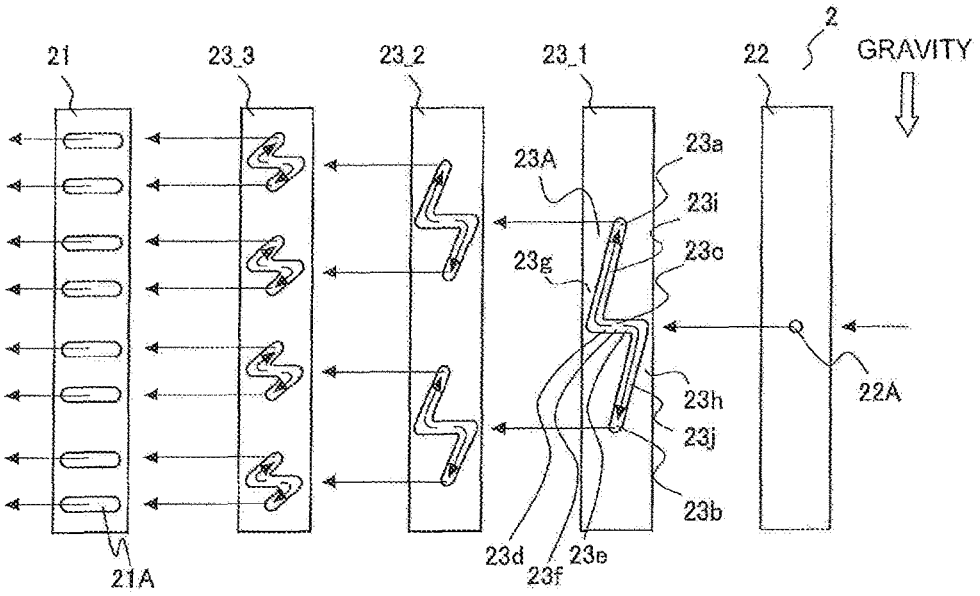
FIG. 3 is a developed view of the stacking-type header of the heat exchanger according to Embodiment 1.

FIG. 3 is a developed view of the stacking-type header of the heat exchanger according to Embodiment 1. As illustrated in FIG. 3, the flow passage 23A formed in the third plate-shaped member 23 has a shape in which an end portion 23*a* and an end portion 23*b* are connected to each other through a straight-line part 23*c*. The straight-line part 23*c* is substantially perpendicular to the gravity direction. The branching flow passage 12*b* is formed by closing, by a member stacked adjacent on the refrigerant inflow side, the flow passage 23A in a region other than a partial region 23*f* (hereinafter referred to as "opening port 23*f*") between an end portion 23*d* and an end portion 23*e* of the straight-line part 23*c*, and closing, by a member stacked adjacent on the refrigerant outflow side, a region other than the end portion 23*a* and the end portion 23*b*. A region of the flow passage 23A, which communicates between the end portion 23*a* and the opening port 23*f*, is defined as a first flow passage 23*g*, and a region of the flow passage 23A, which communicates between the end portion 23*b* and the opening port 23*f*, is defined as a second flow passage 23*h*.

In order to branch the refrigerant flowing into the flow passage 23A to have different heights and cause the refrigerant to flow out therefrom, the end portion 23*a* is positioned on the upper side relative to the opening port 23*f*, and the end portion 23*l* is positioned on the lower side relative to the opening port 23*f*. When the straight line connecting between the end portion 23*a* and the end portion 23*l* is set parallel to the longitudinal direction of the third plate-shaped member 23, the dimension of the third plate-shaped member 23 in the transverse direction can be decreased, which reduces the component cost, the weight, and the like. Further, when the straight line connecting between the end portion 23*a* and the end portion 23*l* is set parallel to the array direction of the first heat transfer tubes 4, space saving can be achieved in the heat exchanger 1.

Figure 4:
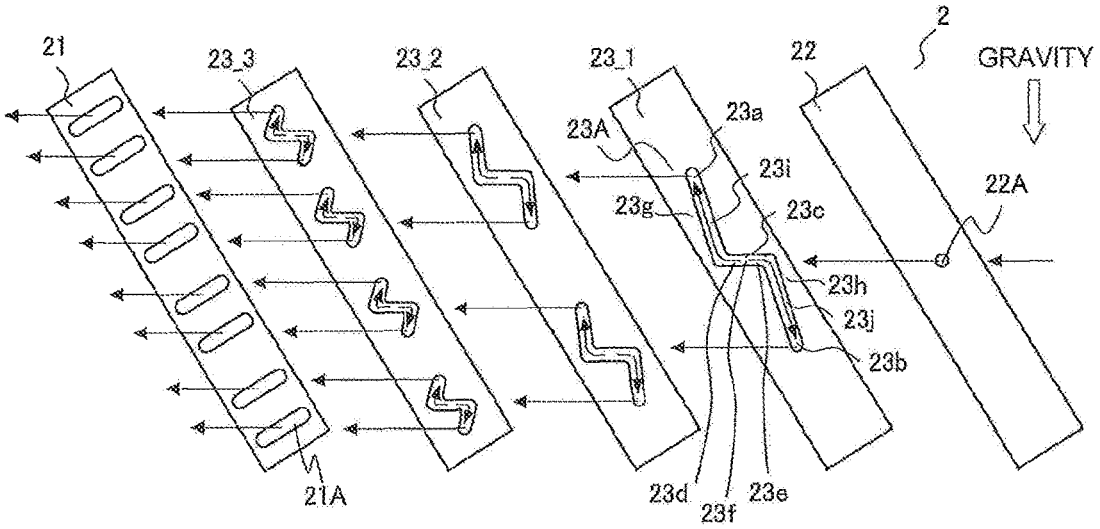
FIG. 4 is a developed view of the stacking-type header of the heat exchanger according to Embodiment 1.

FIG. 4 is a developed view of the stacking-type header of the heat exchanger according to Embodiment 1.

As illustrated in FIG. 4, when the array direction of the first heat transfer tubes 4 is not parallel to the gravity direction, in other words, when the array direction intersects with the gravity direction, the straight-line part 23*c* is not perpendicular to the longitudinal direction of the third plate-shaped member 23. In other words, the stacking-type header 2 is not limited to a stacking-type header in which the plurality of first outlet flow passages 11A are arrayed along the gravity direction, and may be used in a case where the heat exchanger 1 is installed in an inclined manner, such as a heat exchanger for a wall-mounting type room air-conditioning apparatus indoor unit, an outdoor unit for an air-conditioning apparatus, or a chiller outdoor unit. Note that, in FIG. 4, there is illustrated a case where the longitudinal direction of the cross section of the flow passage 21A formed in the first plate-shaped member 21, in other words, the longitudinal direction of the cross section of the first outlet flow passage 11A is perpendicular to the longitudinal direction of the first plate-shaped member 21, but the longitudinal direction of the cross section of the first outlet flow passage 11A may be perpendicular to the gravity direction.

The flow passage 23A may be formed as a through groove shaped so that a connecting part 23*i* for connecting the end portion 23*d* of the straight-line part 23*c* to the end portion 23*a* and a connecting part 23*j* for connecting the end portion 23*e* of the straight-line part 23*c* to the end portion 23*b* are branched, and other flow passages may communicate with the branching flow passage 12*b*. When the other flow passages do not communicate with the branching flow passage 12*b*, the uniformity in distribution of the refrigerant is reliably improved. The connecting parts 23*i* and 23*j* may be each a straight line or a curved line.

Figure 5:
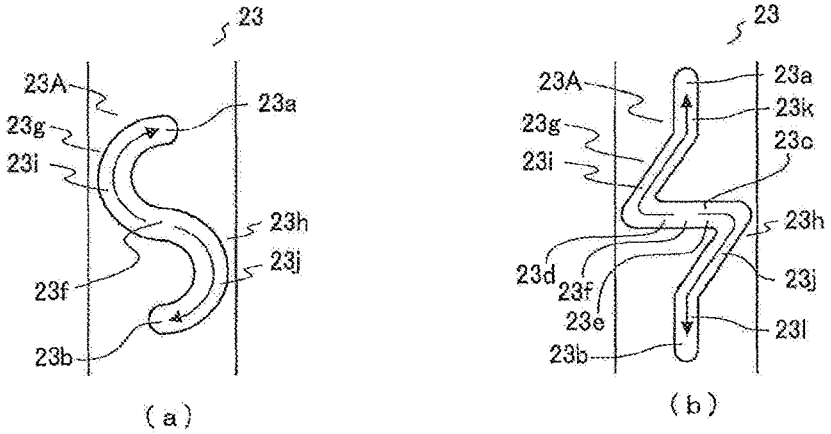
FIG. 5 are views each illustrating a modified example of a flow passage formed in a third plate-shaped member of the heat exchanger according to Embodiment 1.

FIG. 5 are views each illustrating a modified example of the flow passage formed in the third plate-shaped member of the heat exchanger according to Embodiment 1.

As illustrated in FIG. 5(*a*), the flow passage 23A may not include the straight-line part 23*c*. In such a case, a horizontal part between the end portion 23*a* and the end portion 23*b* of the flow passage 23A, which is substantially perpendicular to the gravity direction, serves as the opening port 23*f*. In a case where the flow passage 23A includes the straight-line part 23*c*, when the refrigerant is branched at the opening port 23*f*, the angles of the respective branching directions with respect to the gravity direction are uniform, which reduces the influence of the gravity. When the flow passage 23A does not include the straight-line part 23*c*, the influence of the gravity is increased as compared to the case of including the straight-line part 23*c*. However, a difference between a flow resistance to act on the refrigerant passing through the first flow passage 23*g* and a flow resistance to act on the refrigerant passing through the second flow passage 23*h* are set smaller so that the uniformity in distribution of the refrigerant can be improved.

As illustrated in FIG. 5(*b*), each of the end portion 23*a* and the end portion 23*b* may communicate with each of the connecting parts 23*i* and 23*j* through each of straight-line parts 23*k* and 23*l* parallel to the gravity direction. When each of the end portions 23*a* and 23*b* communicates with each of the connecting parts 23*i* and 23*j* through the straight-line parts 23*k* and 23*l*, drift caused when the refrigerant passes through the connecting parts 23*i* and 23*j* not parallel to the gravity direction is uniformized so that the uniformity in distribution of the refrigerant can be improved.

<Flow of Refrigerant in Laminated Header>

Now, the flow of the refrigerant in the stacking-type header of the heat exchanger according to Embodiment 1 is described.

As illustrated in FIG. 3 and FIG. 4, the refrigerant passing through the flow passage 22A of the second plate-shaped member 22 flows into the opening port 23*f* of the flow passage 23A formed in the third plate-shaped member 23_1. The refrigerant flowing into the opening port 23*f* hits against the surface of the member stacked adjacent to the third plate-shaped member 23_1, and is branched into two flows respectively toward the end portion 23*d* and the end portion 23*e* of the straight-line part 23*c*. The branched refrigerant reaches each of the end portions 23*a* and 23*b* of the flow passage 23A and flows into the opening port 23*f* of the flow passage 23A formed in the third plate-shaped member 23_2.

Similarly, the refrigerant flowing into the opening port 23*f* of the flow passage 23A formed in the third plate-shaped member 23_2 hits against the surface of the member stacked adjacent to the third plate-shaped member 23_2, and is branched into two flows respectively toward the end portion 23*d* and the end portion 23*e* of the straight-line part 23*c*. The branched refrigerant reaches each of the end portions 23*a* and 23*b* of the flow passage 23A, and flows into the opening port 23*f* of the flow passage 23A formed in the third plate-shaped member 23_3.

Similarly, the refrigerant flowing into the opening port 23*f* of the flow passage 23A formed in the third plate-shaped member 23_3 hits against the surface of the member stacked adjacent to the third plate-shaped member 23_3, and is branched into two flows respectively toward the end portion 23*d* and the end portion 23*e* of the straight-line part 23*c*. The branched refrigerant reaches each of the end portions 23*a* and 23*b* of the flow passage 23A, and passes through the flow passage 21A of the first plate-shaped member 21 to flow into the first heat transfer tube 4.

<Method of Laminating Plate-Like Members>

Now, a method of stacking the respective plate-shaped members of the stacking-type header of the heat exchanger according to Embodiment 1 is described.

The respective plate-shaped members may be stacked by brazing. A both-side clad member having a brazing material rolled on both surfaces thereof may be used for all of the plate-shaped members or alternate plate-shaped members to supply the brazing material for joining. A one-side clad member having a brazing material rolled on one surface thereof may be used for all of the plate-shaped members to supply the brazing material for joining. A brazing-material sheet may be stacked between the respective plate-shaped members to supply the brazing material. A paste brazing material may be applied between the respective plate-shaped members to supply the brazing material. A both-side clad member having a brazing material rolled on both surfaces thereof may be stacked between the respective plate-shaped members to supply the brazing material.

Through lamination with use of brazing, the plate-shaped members are stacked without a gap therebetween, which suppresses leakage of the refrigerant and further secures the pressure resistance. When the plate-shaped members are pressurized during brazing, the occurrence of brazing failure is further suppressed. When processing that promotes formation of a fillet, such as forming a rib at a position at which leakage of the refrigerant is liable to occur, is performed, the occurrence of brazing failure is further suppressed.

Further, when all of the members to be subjected to brazing, including the first heat transfer tube 4 and the fin 6, are made of the same material (for example, made of aluminum), the members may be collectively subjected to brazing, which improves the productivity. After the brazing in the stacking-type header 2 is performed, the brazing of the first heat transfer tube 4 and the fin 6 may be performed. Further, only the first plate-shaped unit 11 may be first joined to the retaining member 5 by brazing, and the second plate-shaped unit 12 may be joined by brazing thereafter.

Figure 6:
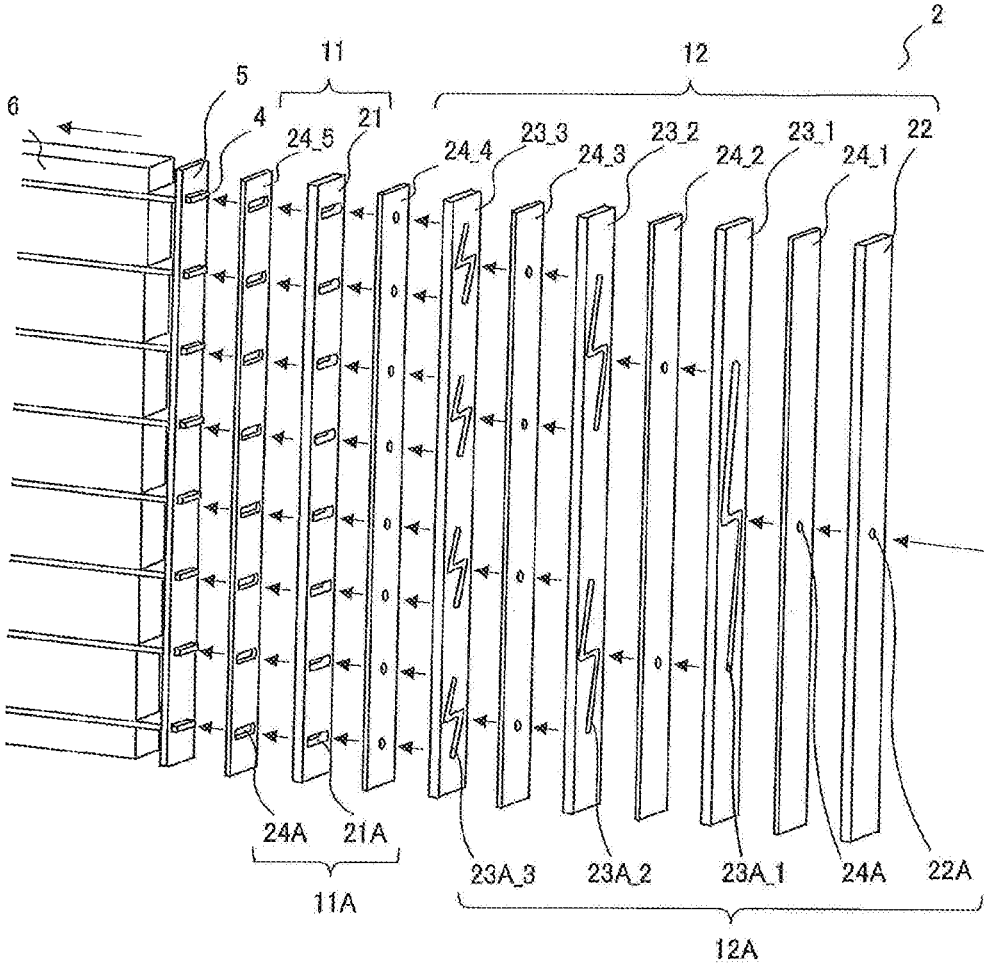
FIG. 6 is a perspective view illustrating the heat exchanger according to Embodiment 1 under a state in which the stacking-type header is disassembled.
Figure 7:
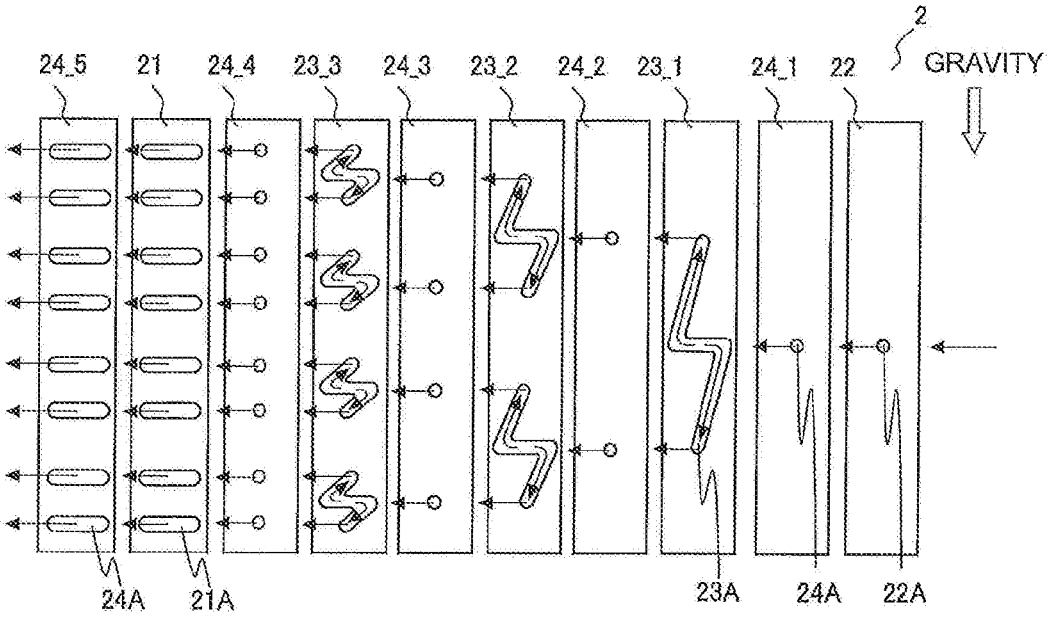
FIG. 7 is a developed view of the stacking-type header of the heat exchanger according to Embodiment 1.

FIG. 6 is a perspective view of the heat exchanger according to Embodiment 1 under a state in which the stacking-type header is disassembled. FIG. 7 is a developed view of the stacking-type header of the heat exchanger according to Embodiment 1.

In particular, a plate-shaped member having a brazing material rolled on both surfaces thereof, in other words, a both-side clad member may be stacked between the respective plate-shaped members to supply the brazing material. As illustrated in FIG. 6 and FIG. 7, a plurality of both-side clad members 24_1 to 24_5 are stacked between the respective plate-shaped members. In the following, in some cases, the plurality of both-side clad members 24_1 to 24_5 are collectively referred to as the both-side clad member 24. Note that, the both-side clad member 24 may be stacked between a part of the plate-shaped members, and a brazing material may be supplied between the remaining plate-shaped members by other methods.

The both-side clad member 24 has a flow passage 24A, which passes through the both-side clad member 24, formed in a region that is opposed to a refrigerant outflow region of the flow passage formed in the plate-shaped member stacked adjacent on the refrigerant inflow side. The flow passage 24A formed in the both-side clad member 24 stacked between the second plate-shaped member 22 and the third plate-shaped member 23 is a circular through hole. The flow passage 24A formed in the both-side clad member 24_5 stacked between the first plate-shaped member 21 and the retaining member 5 is a through hole having an inner peripheral surface shaped conforming to the outer peripheral surface of the first heat transfer tube 4.

When the both-side clad member 24 is stacked, the flow passage 24A functions as a refrigerant partitioning flow passage for the first outlet flow passage 11A and the distribution flow passage 12A. Under a state in which the both-side clad member 24_5 is stacked on the retaining member 5, the end portions of the first heat transfer tubes 4 may be or not be projected from the surface of the both-side clad member 24_5. When the flow passage 24A is formed by press working or other processing, the work is simplified, and the manufacturing cost and the like are reduced. When all of the members to be subjected to brazing, including the both-side clad member 24, are made of the same material (for example, made of aluminum), the members may be collectively subjected to brazing, which improves the productivity.

Through formation of the refrigerant partitioning flow passage by the both-side clad member 24, in particular, the branched flows of refrigerant flowing out from the branching flow passage 12*b* can be reliably partitioned from each other. Further, by the amount of the thickness of each both-side clad member 24, an entrance length for the refrigerant flowing into the branching flow passage 12*b* or the first outlet flow passage 11A can be secured, which improves the uniformity in distribution of the refrigerant. Further, the flows of the refrigerant can be reliably partitioned from each other, and hence the degree of freedom in design of the branching flow passage 12*b* can be increased.

<Details of Flow Passage of Third Plate-Like Member>

Figure 8:
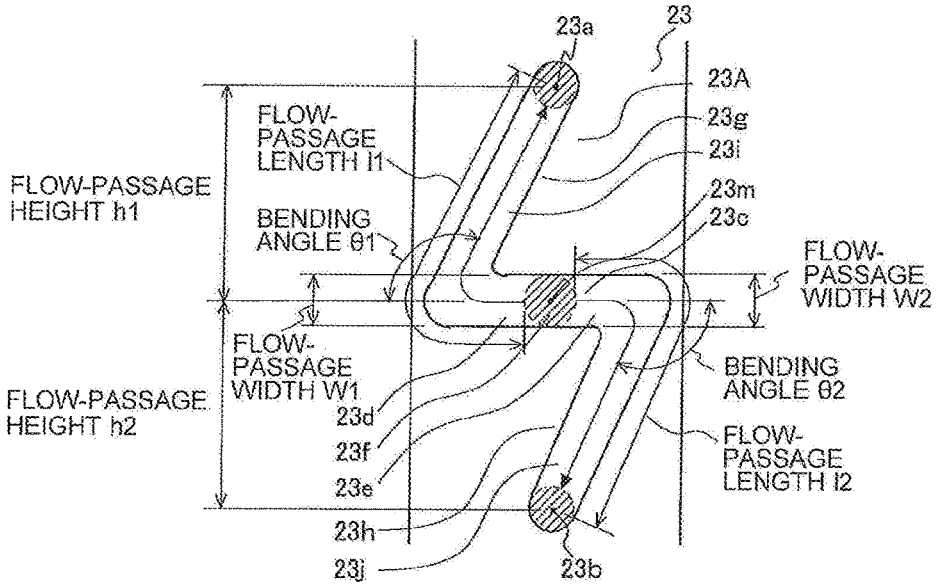
FIG. 8 is a view illustrating a comparative example of the flow passage formed in the third plate-shaped member of the heat exchanger according to Embodiment 1.

FIG. 8 is a view illustrating a comparative example of the flow passage formed in the third plate-shaped member of the heat exchanger according to Embodiment 1. Note that, in FIG. 8, a part of the flow passage formed in a member stacked adjacent to the third plate-shaped member is indicated by the dotted lines. A state in which the both-side clad member 24 is stacked on the third plate-shaped member 23 is illustrated (state of FIG. 6 and FIG. 7), but the same holds true in a state in which the both-side clad member 24 is not stacked (state of FIG. 2 and FIG. 3).

First, as the comparative example, description is made of the flow passage 23A of the third plate-shaped member 23 when the first flow passage 23*g* and the second flow passage 23*h* are equal to each other in flow-passage resistance, and are point symmetric with each other about the opening port 23*f*.

As illustrated in FIG. 8, a height difference between the end portion 23*a* and a center 23*m* of the opening port 23*f* is defined as a flow-passage height h1, a height difference between the end portion 23*b* and the center 23*m* of the opening port 23*f* is defined as a flow-passage height h2, a flow-passage length of the first flow passage 23*g* is defined as a flow-passage length l1, a flow-passage length of the second flow passage 23*h* is defined as a flow-passage length l2, a flow-passage width of the first flow passage 23*g* is defined as a flow-passage width W1, a flow-passage width of the second flow passage 23*h* is defined as a flow-passage width W2, a bending angle of the first flow passage 23*g* is defined as a bending angle θ1, and a bending angle of the second flow passage 23*h* is defined as a bending angle θ2. Further, a thickness of the third plate-shaped member 23, that is, a flow-passage depth thereof is defined as δ. Note that, the center of the refrigerant outflow region of the first flow passage 23*g* is defined as the end portion 23*a*, and the center of the refrigerant outflow region of the second flow passage 23*h* is defined as the end portion 23*b*.

When the first flow passage 23*g* and the second flow passage 23*h* are equal to each other in flow-passage resistance, and are point symmetric with each other about the opening port 23*f*, h1 is equal to h2, l1 is equal to l2, W1 is equal to W2, and θ1 is equal to θ2, and a surface property of the first flow passage 23*g* and a surface property of the second flow passage 23*h* are equal to each other.

Further, a pressure of the refrigerant flowing into the opening port 23*f* is defined as a pressure P0, a pressure of the refrigerant flowing out from the end portion 23*a* is defined as a pressure P1, a pressure of the refrigerant flowing out from the end portion 23*b* is defined as a pressure P2, a pressure loss caused due to the flow-passage resistance in the first flow passage 23*g* is defined as a pressure loss ΔPf1, and a pressure loss caused due to the flow-passage resistance in the second flow passage 23*h* is defined as a pressure loss ΔPf2.

The pressure P1 of the refrigerant flowing out from the end portion 23*a* and the pressure P2 of the refrigerant flowing out from the end portion 23*b* are calculated by (Expression 1) and (Expression 2) below using a density p [kg/m$^3$] of the refrigerant.

[Math. 1]

Expression 1

$$P1=P0-\Delta Pf1-\rho\cdot g\cdot h1 \quad (式1)$$

[Math. 2]

Expression 2

$$P2=P0-\Delta Pf2+\rho\cdot g\cdot h2 \quad (式2)$$

When the first flow passage 23*g* and the second flow passage 23*h* are equal to each other in flow-passage resistance, and are point symmetric with each other about the opening port 23*f*, the pressure loss ΔPf1 caused due to the flow-passage resistance in the first flow passage 23*g* and the pressure loss ΔPf2 caused due to the flow-passage resistance in the second flow passage 23*h* are equal to each other. Further, h1 is equal to h2, and hence ρ·g·h1 and ρ·g·h2 are equal to each other.

Therefore, the pressure P1 of the refrigerant flowing out from the end portion 23*a* and the pressure P2 of the refrigerant flowing out from the end portion 23*b* are not equal to each other because a flow resistance in the first flow passage 23*g*, that is, a pressure loss (ΔPf1+ρ·g·h1) generated in the refrigerant passing through the first flow passage 23*g* and a flow resistance in the second flow passage 23*h*, that is, a pressure loss (ΔPf2−ρ·g·h2) generated in the refrigerant passing through the second flow passage 23*h* are different from each other. As a result, a flow rate of the refrigerant flowing out from the end portion 23*a* and a flow rate of the refrigerant flowing out from the end portion 23*b* are non-uniform.

On the other hand, the pressure loss ΔPf1 caused due to the flow-passage resistance in the first flow passage 23*g* and the pressure loss ΔPf2 caused due to the flow-passage resistance in the second flow passage 23*h* are respectively expressed by (Expression 3) and (Expression 4) below by using a friction coefficient λ1 [dimensionless] of the first flow passage 23*g*, a friction coefficient λ2 [dimensionless] of the second flow passage 23*h*, a hydraulic equivalent diameter dh1 [m] of the first flow passage 23*g*, a hydraulic equivalent diameter dh2 [m] of the second flow passage 23*h*, a flow velocity u1 [m/s] of the refrigerant flowing through the first flow passage 23*g*, a flow velocity u2 [m/s] of the refrigerant flowing through the second flow passage 23*h*, and a flow rate Gr [kg/s] of the refrigerant.

[Math. 3]

Expression 3

$$\begin{aligned}\Delta Pf1 &= \lambda 1\cdot\left(\frac{L1}{dh1}\right)\cdot\left(\frac{\rho\cdot u1^2}{2}\right)\\ &= \lambda 1\cdot\left(\frac{L1}{dh1}\right)\cdot\left(\frac{\rho}{2}\right)\cdot\left(\frac{Gr}{\rho\cdot W1\cdot\delta}\right)^2\\ &= \lambda 1\cdot\left(\frac{L1}{dh1}\right)\cdot\left(\frac{1}{2\rho}\right)\cdot\left(\frac{Gr}{W1\cdot\delta}\right)^2\end{aligned} \quad (式3)$$

[Math. 4]

Expression 4

$$\begin{aligned}\Delta Pf2 &= \lambda 2\cdot\left(\frac{L2}{dh2}\right)\cdot\left(\frac{\rho\cdot u2^2}{2}\right)\\ &= \lambda 2\cdot\left(\frac{L2}{dh2}\right)\cdot\left(\frac{\rho}{2}\right)\cdot\left(\frac{Gr}{\rho\cdot W2\cdot\delta}\right)^2\\ &= \lambda 2\cdot\left(\frac{L2}{dh2}\right)\cdot\left(\frac{2}{2\rho}\right)\cdot\left(\frac{Gr}{W2\cdot\delta}\right)^2\end{aligned} \quad (式4)$$

As apparent also from (Expression 3) and (Expression 4), the pressure loss ΔPf1 caused due to the flow-passage resistance in the first flow passage 23*g* and the pressure loss ΔPf2 caused due to the flow-passage resistance in the second flow passage 23*h* have parameters such as the flow-passage lengths l1 and l2, the flow-passage widths W1 and W2, and the friction coefficients λ1 and λ2, respectively. Thus, through changing of those parameters, it is possible to reduce a difference between the pressure loss ($\Delta Pf1+\rho \cdot g \cdot h1$) generated in the refrigerant passing through the first flow passage 23*g* and the pressure loss ($\Delta Pf2-\rho \cdot g \cdot h2$) generated in the refrigerant passing through the second flow passage 23*h*. Further, through changing of the flow-passage heights h1 and h2, it is possible to reduce the difference between the pressure loss ($\Delta Pf1+\rho \cdot g \cdot h1$) generated in the refrigerant passing through the first flow passage 23*g* and the pressure loss ($\Delta Pf2-\rho \cdot g \cdot h2$) generated in the refrigerant passing through the second flow passage 23*h*. Further, the difference between the pressure loss ($\Delta Pf1+\rho \cdot g \cdot h1$) generated in the refrigerant passing through the first flow passage 23*g* and the pressure loss ($\Delta Pf2-\rho \cdot g\ h2$) generated in the refrigerant passing through the second flow passage 23*h* can be set to 0 as necessary.

That is, as described in specific examples below, the flow passage 23A of the third plate-shaped member 23 is improved so as to reduce the difference in flow resistance between the first flow passage 23*g* and the second flow passage 23*h* as compared to that in a state in which the flow-passage resistances in the first flow passage 23*g* and the second flow passage 23*h* are equal to each other, and in a state in which the first flow passage 23*g* and the second flow passage 23*h* are point symmetric with each other about the opening port 23*f*. As a result, the flow rate of the refrigerant flowing out from the end portion 23*a* and the flow rate of the refrigerant flowing out from the end portion 23*b* are equalized, which improves the uniformity in distribution of the refrigerant in the stacking-type header 2. Note that, it is needless to say that the respective specific examples may be combined with each other.

Specific Example-1

Figure 9:
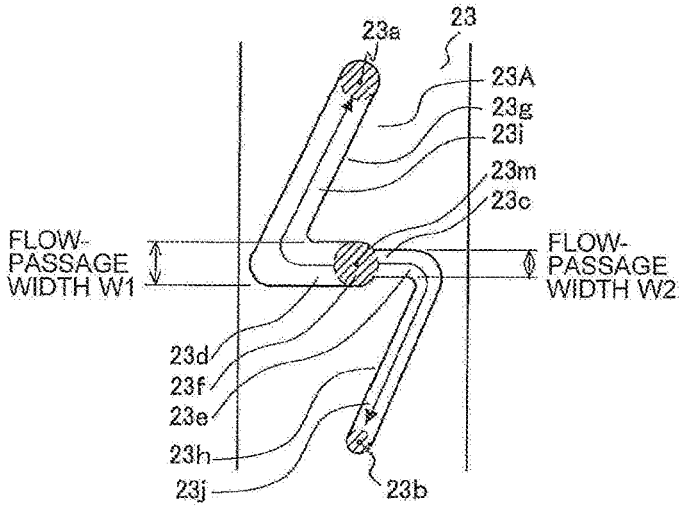
FIG. 9 is a view illustrating Specific Example-1 of the flow passage formed in the third plate-shaped member of the heat exchanger according to Embodiment 1.

FIG. 9 is a view illustrating Specific Example-1 of the flow passage formed in the third plate-shaped member of the heat exchanger according to Embodiment 1.

As illustrated in FIG. 9, in the flow passage 23A, the flow-passage width W2 of the second flow passage 23*h* is smaller than the flow-passage width W1 of the first flow passage 23*g*. In such a case, the flow-passage resistance in the second flow passage 23*h* is larger than the flow-passage resistance in the first flow passage 23*g*, thereby suppressing the increase in flow rate of the refrigerant flowing into the second flow passage 23*h* due to the influence of the gravity.

Figure 10:
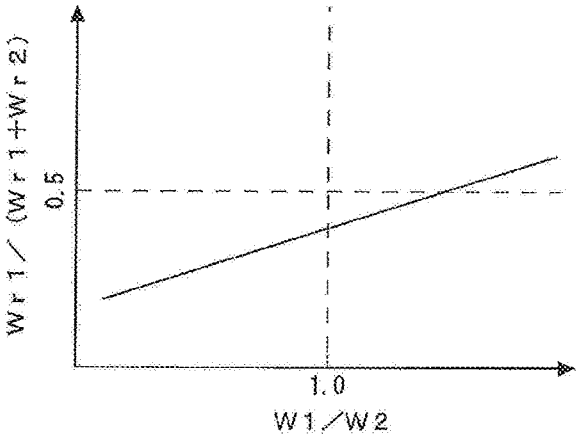
FIG. 10 is a graph showing effects of Specific Example-1 of the flow passage formed in the third plate-shaped member of the heat exchanger according to Embodiment 1.

FIG. 10 is a graph showing effects of Specific Example-1 of the flow passage formed in the third plate-shaped member of the heat exchanger according to Embodiment 1. Note that, the flow rate of the refrigerant flowing through the first flow passage 23*g* is defined as Wr1, and the flow rate of the refrigerant flowing through the second flow passage 23*h* is defined as Wr2.

As shown in FIG. 10, when the flow-passage width W1 of the first flow passage 23*g* and the flow-passage width W2 of the second flow passage 23*h* are equal to each other, that is, W1/W2 is 1.0, the flow rate Wr1 of the refrigerant flowing through the first flow passage 23*g* is lower than the flow rate Wr2 of the refrigerant flowing through the second flow passage 23*h*. When the flow-passage width W2 of the second flow passage 23*h* is set smaller than the flow-passage width W1 of the first flow passage 23*g*, a ratio of the flow rate Wr1 of the refrigerant flowing through the first flow passage 23*g* to a sum of the flow rate Wr1 of the refrigerant flowing through the first flow passage 23*g* and the flow rate Wr2 of the refrigerant flowing through the second flow passage 23*h* can approach 0.5.

Specific Example-2

Figure 11:
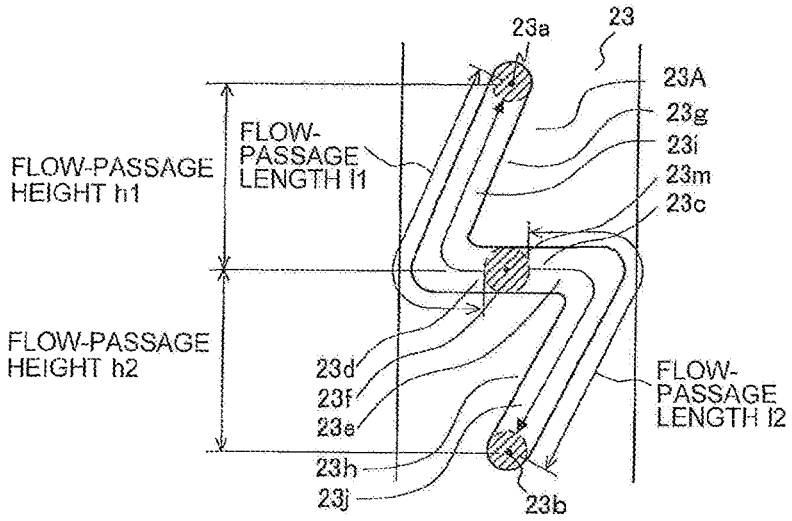
FIG. 11 is a view illustrating Specific Example-2 of the flow passage formed in the third plate-shaped member of the heat exchanger according to Embodiment 1.

FIG. 11 is a view illustrating Specific Example-2 of the flow passage formed in the third plate-shaped member of the heat exchanger according to Embodiment 1.

As illustrated in FIG. 11, in the flow passage 23A, the flow-passage length l2 of the second flow passage 23*h* is larger than the flow-passage length l1 of the first flow passage 23*g*. In such a case, the flow-passage resistance in the second flow passage 23*h* is larger than the flow-passage resistance in the first flow passage 23*g*, thereby suppressing the increase in flow rate of the refrigerant flowing into the second flow passage 23*h* due to the influence of the gravity. Effects of Specific Example-2 are the same as those obtained by changing the horizontal axis of FIG. 9 to l2/l1.

Figure 12:
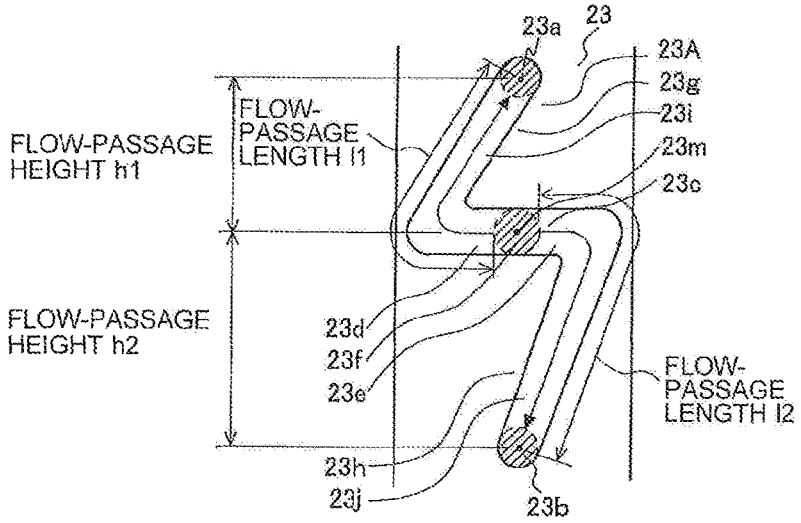
FIG. 12 is a view illustrating Specific Example-2 of the flow passage formed in the third plate-shaped member of the heat exchanger according to Embodiment 1.

FIG. 12 is a view illustrating Specific Example-2 of the flow passage formed in the third plate-shaped member of the heat exchanger according to Embodiment 1.

In FIG. 11, there is illustrated a case where the flow-passage length l2 of the second flow passage 23*h* is set larger than the flow-passage length l1 of the first flow passage 23*g* under a state in which the flow-passage height h1 of the first flow passage 23*g* and the flow-passage height h2 of the second flow passage 23*h* are set equal to each other. However, as illustrated in FIG. 12, the flow-passage height h2 of the second flow passage 23*h* may be set larger than the flow-passage height h1 of the first flow passage 23*g* in order that the flow-passage length l2 of the second flow passage 23*h* is larger than the flow-passage length l1 of the first flow passage 23*g*.

The flow-passage height h2 of the second flow passage 23*h* may be set larger than the flow-passage height h1 of the first flow passage 23*g* without changing a sum of the flow-passage height h1 of the first flow passage 23*g* and the flow-passage height h2 of the second flow passage 23*h*. Further, the flow-passage height h2 of the second flow passage 23*h* may be set larger than the flow-passage height h1 of the first flow passage 23*g* while changing the sum of the flow-passage height h1 of the first flow passage 23*g* and the flow-passage height h2 of the second flow passage 23*h*. When the flow-passage height h2 of the second flow passage 23*h* is set larger than the flow-passage height h1 of the first flow passage 23*g* while reducing the sum of the flow-passage height h1 of the first flow passage 23*g* and the flow-passage height h2 of the second flow passage 23*h*, for example, when the flow-passage height h1 of the first flow passage 23*g* is set smaller without changing the flow-passage height h2 of the second flow passage 23*h*, the flow-passage length l2 of the second flow passage 23*h* is larger than the flow-passage length l1 of the first flow passage 23*g*, and in addition; $\rho \cdot g(h1+h2)$ can be reduced, thereby further reducing the difference between the pressure loss ($\Delta Pf1+\rho \cdot g \cdot h1$) generated in the refrigerant passing through the first flow passage 23*g* and the pressure loss ($\Delta Pf2-\rho \cdot g \cdot h2$) generated in the refrigerant passing through the second flow passage 23*h*. In such a case, it is necessary to narrow the interval between the plurality of first outlet flow passages 11A, that is, the interval between the first heat transfer tubes 4. Note that, the flow-passage height h2 of the second flow passage 23*h* may be set larger than the flow-passage height h1 of the first flow passage 23*g* while increasing the sum of the flow-passage height h1 of the first flow passage 23*g* and the flow-passage height h2 of the second flow passage 23*h*.

Specific Example-3

Figure 13:
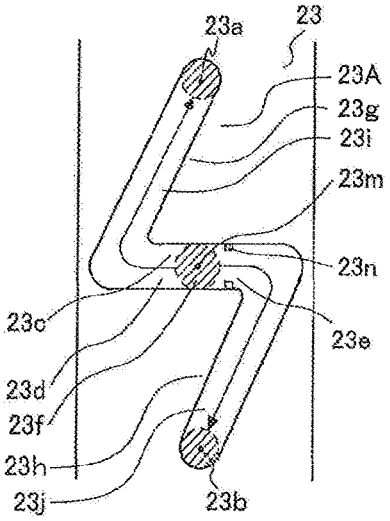
FIG. 13 is a view illustrating Specific Example-3 of the flow passage formed in the third plate-shaped member of the heat exchanger according to Embodiment 1.

FIG. 13 is a view illustrating Specific Example-3 of the flow passage formed in the third plate-shaped member of the heat exchanger according to Embodiment 1.

As illustrated in FIG. 13, in the flow passage 23A, the second flow passage 23*h* has a projecting portion 23*n* formed therein, which projects inward from the flow passage. The projecting portion 23*n* is an annular reducing portion, a semispherical projection, or the like. In such a case, the sectional area of the second flow passage 23*h* is reduced so that the flow-passage resistance in the second flow passage 23*h* is larger than the flow-passage resistance in the first flow passage 23*g*, thereby suppressing the increase in flow rate of the refrigerant flowing into the second flow passage 23*h* due to the influence of the gravity. The projecting portion 23*n* may be formed through insertion of a projecting portion formed on a member stacked adjacent to the third plate-shaped member into the flow passage 23A. Note that, in the first flow passage 23*g*, there may be formed a projecting portion having a projection amount smaller than that of the projecting portion 23*n* formed in the second flow passage 23*h*.

Specific Example-4

In the flow passage 23A, a surface roughness Ra2 of the second flow passage 23*h* is higher than a surface roughness Ra1 of the first flow passage 23*g*. In such a case, the friction coefficient λ2 of the second flow passage 23*h* is increased so that the flow-passage resistance in the second flow passage 23*h* is larger than the flow-passage resistance in the first flow passage 23*g*, thereby suppressing the increase in flow rate of the refrigerant flowing into the second flow passage 23*h* due to the influence of the gravity. Effects of Specific Example-4 are the same as those obtained by changing the horizontal axis of FIG. 9 to Ra2/Ra1.

Specific Example-5

Figure 14:
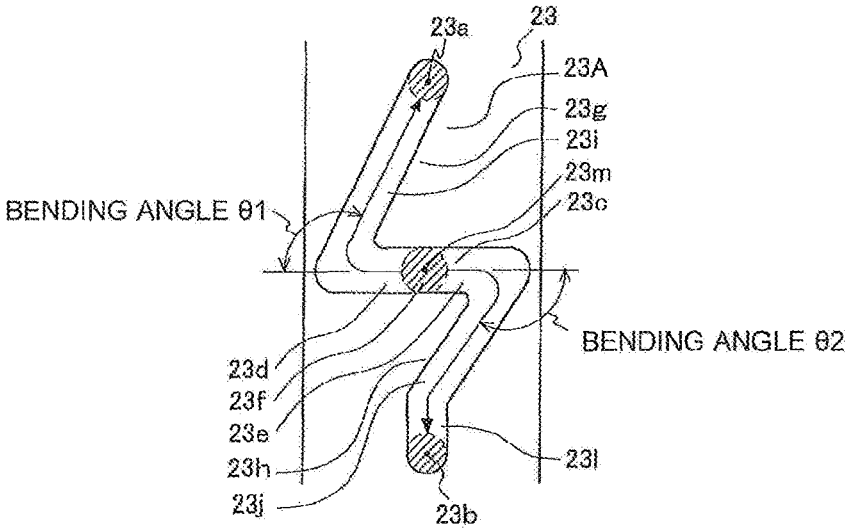
FIG. 14 is a view illustrating Specific Example-5 of the flow passage formed in the third plate-shaped member of the heat exchanger according to Embodiment 1.
Figure 15:
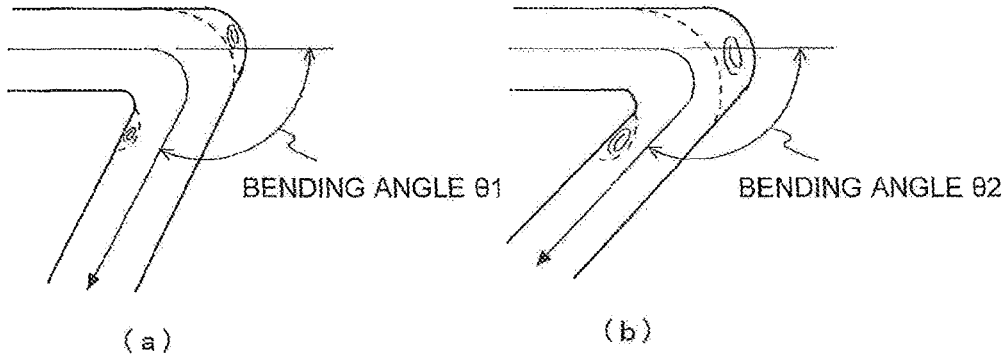
FIG. 15 are views each illustrating a state of refrigerant of Specific Example-5 of the flow passage formed in the third plate-shaped member of the heat exchanger according to Embodiment 1.

FIG. 14 is a view illustrating Specific Example-5 of the flow passage formed in the third plate-shaped member of the heat exchanger according to Embodiment 1, FIG. 15 are views each illustrating a state of the refrigerant of Specific Example-5 of the flow passage formed in the third plate-shaped member of the heat exchanger according to Embodiment 1. Note that, FIG. 15(*a*) illustrates a case where the bending angle θ2 of the second flow passage 23*h* is smaller, and FIG. 15(*b*) illustrates a case where the bending angle θ2 of the second flow passage 23*h* is larger.

As illustrated in FIG. 14, in the flow passage 23A, the bending angle θ2 of the second flow passage 23*h* is larger than the bending angle θ1 of the first flow passage 23*g*. As illustrated in FIG. 15, the flow of the refrigerant is disturbed to cause vortexes on an outer side of the bending portion and an inner side of the bending portion on the refrigerant outflow side. When the bending angle θ2 of the second flow passage 23*h* is larger than the bending angle θ1 of the first flow passage 23*g*, a region in which the flow of the refrigerant is disturbed is increased in the second flow passage 23*h* so that the influence of the vortexes is increased. Thus, the flow-passage resistance in the second flow passage 23*h* is larger than the flow-passage resistance in the first flow passage 23*g*, thereby suppressing the increase in flow rate of the refrigerant flowing into the second flow passage 23*h* due to the influence of the gravity. Effects of Specific Example-5 are the same as those obtained by changing the horizontal axis of FIG. 9 to θ2/θ1.

When the end portion 23*b* and the connecting part 23*j* communicate with each other through the straight-line part 23*l* parallel to the gravity direction in order to increase the bending angle θ2, the drift caused when the refrigerant passes through the connecting part 23*j* not parallel to the gravity direction is uniformized so that the uniformity in distribution of the refrigerant can be further improved.

Specific Example-6

Figure 16:
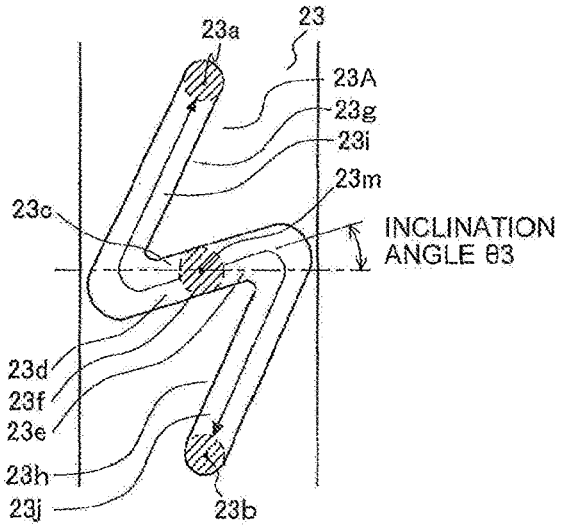
FIG. 16 is a view illustrating Specific Example-6 of the flow passage formed in the third plate-shaped member of the heat exchanger according to Embodiment 1.

FIG. 16 is a view illustrating Specific Example-6 of the flow passage formed in the third plate-shaped member of the heat exchanger according to Embodiment 1.

As illustrated in FIG. 16, in the flow passage 23A, the straight-line part 23*c* is inclined by an inclination angle θ3 from a direction perpendicular to the gravity direction so that the second flow passage 23*h* side is higher. In such a case, in the straight-line part 23*c*, the refrigerant flowing through the first flow passage 23*g* utilizes the gravity, and the refrigerant flowing through the second flow passage 23*h* resists the gravity. Thus, the flow-passage resistance in the second flow passage 23*h* is larger than the flow-passage resistance in the first flow passage 23*g*, thereby suppressing the increase in flow rate of the refrigerant flowing into the second flow passage 23*h* due to the influence of the gravity. As illustrated in FIG. 5(*a*), the flow passage 23A may not include the straight-line part 23*c*. The first flow passage 23*g* may communicate with the opening port 23*f* from a lower side of the opening port 23*f*, and the second flow passage 23*h* may communicate with the opening port 23*f* from an upper side of the opening port 23*f*.

<Usage Mode of Heat Exchanger>

Now, an example of a usage mode of the heat exchanger according to Embodiment 1 is described.

Note that, in the following, there is described a case where the heat exchanger according to Embodiment 1 is used for an air-conditioning apparatus, but the present invention is not limited to such a case, and for example, the heat exchanger according to Embodiment 1 may be used for other refrigeration cycle apparatus including a refrigerant circuit. Further, there is described a case where the air-conditioning apparatus switches between a cooling operation and a heating operation, but the present invention is not limited to such a case, and the air-conditioning apparatus may perform only the cooling operation or the heating operation.

Figure 17:
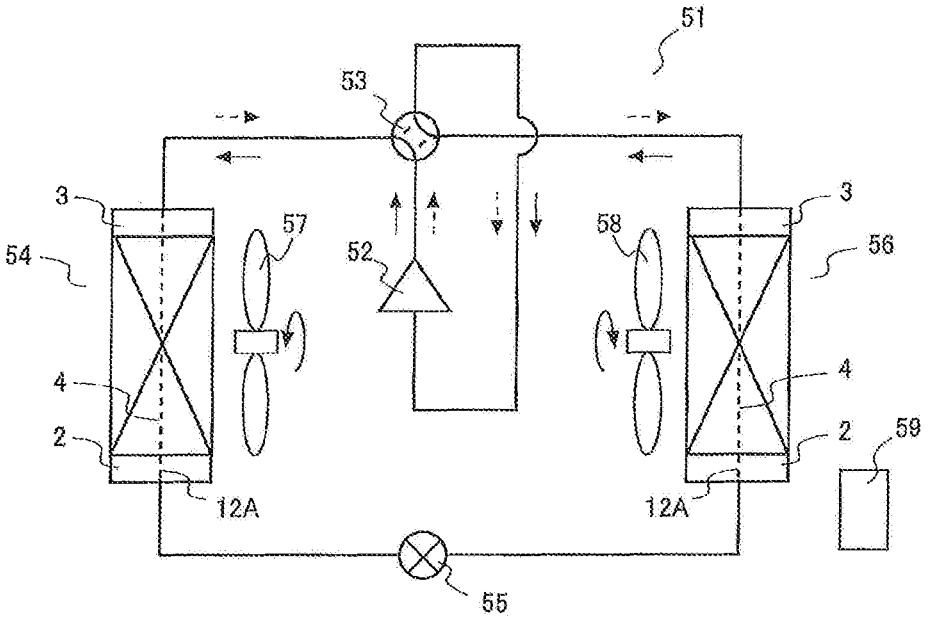
FIG. 17 is a diagram illustrating a configuration of an air-conditioning apparatus to which the heat exchanger according to Embodiment 1 is applied.

FIG. 17 is a view illustrating the configuration of the air-conditioning apparatus to which the heat exchanger according to Embodiment 1 is applied. Note that, in FIG. 17, the flow of the refrigerant during the cooling operation is indicated by the solid arrow, while the flow of the refrigerant during the heating operation is indicated by the dotted arrow.

As illustrated in FIG. 17, an air-conditioning apparatus 51 includes a compressor 52, a four-way valve 53, a heat source-side heat exchanger 54, an expansion device 55, a load-side heat exchanger 56, a heat source-side fan 57, a load-side fan 58, and a controller 59. The compressor 52, the four-way valve 53, the heat source-side heat exchanger 54, the expansion device 55, and the load-side heat exchanger 56 are connected by refrigerant pipes to form a refrigerant circuit.

The controller 59 is connected to, for example, the compressor 52, the four-way valve 53, the expansion device 55, the heat source-side fan 57, the load-side fan 58, and various sensors. The controller 59 switches the flow passage of the four-way valve 53 to switch between the cooling operation and the heating operation. The heat source-side heat exchanger 54 acts as a condenser during the cooling operation, and acts as an evaporator during the heating operation. The load-side heat exchanger 56 acts as the evaporator during the cooling operation, and acts as the condensor during the heating operation.

The flow of the refrigerant during the cooling operation is described.

The refrigerant in a high-pressure and high-temperature gas state discharged from the compressor 52 passes through the four-way valve 53 to flow into the heat source-side heat exchanger 54, and is condensed through heat exchange with the outside air supplied by the heat source-side fan 57, to thereby become the refrigerant in a high-pressure liquid state, which flows out from the heat source-side heat exchanger 54. The refrigerant in the high-pressure liquid state flowing out from the heat source-side heat exchanger 54 flows into the expansion device 55 to become the refrigerant in a low-pressure two-phase gas-liquid state. The refrigerant in the low-pressure two-phase gas-liquid state flowing out from the expansion device 55 flows into the load-side heat exchanger 56 to be evaporated through heat exchange with indoor air supplied by the load-side fan 58, to thereby become the refrigerant in a low-pressure gas state, which flows out from the load-side heat exchanger 56. The refrigerant in the low-pressure gas state flowing out from the load-side heat exchanger 56 passes through the four-way valve 53 to be sucked into the compressor 52.

The flow of the refrigerant during the heating operation is described.

The refrigerant in a high-pressure and high-temperature gas state discharged from the compressor 52 passes through the four-way valve 53 to flow into the load-side heat exchanger 56, and is condensed through heat exchange with the indoor air supplied by the load-side fan 58, to thereby become the refrigerant in a high-pressure liquid state, which flows out from the load-side heat exchanger 56. The refrigerant in the high-pressure liquid state flowing out from the load-side heat exchanger 56 flows into the expansion device 55 to become the refrigerant in a low-pressure two-phase gas-liquid state. The refrigerant in the low-pressure two-phase gas-liquid state flowing out from the expansion device 55 flows into the heat source-side heat exchanger 54 to be evaporated through heat exchange with the outside air supplied by the heat source-side fan 57, to thereby become the refrigerant in a low-pressure gas state, which flows out from the heat source-side heat exchanger 54. The refrigerant in the low-pressure gas state flowing out from the heat source-side heat exchanger 54 passes through the four-way valve 53 to be sucked into the compressor 52.

The heat exchanger 1 is used for at least one of the heat source-side heat exchanger 54 or the load-side heat exchanger 56. When the heat exchanger 1 acts as the evaporator, the heat exchanger 1 is connected so that the refrigerant flows in from the stacking-type header 2 and the refrigerant flows out from the header 3. In other words, when the heat exchanger 1 acts as the evaporator, the refrigerant in the two-phase gas-liquid state passes through the refrigerant pipe to flow into the stacking-type header 2, and the refrigerant in the gas state passes through the first heat transfer tube 4 to flow into the header 3. Further, when the heat exchanger 1 acts as the condenser, the refrigerant in the gas state passes through the refrigerant pipe to flow into the header 3, and the refrigerant in the liquid state passes through the first heat transfer tube 4 to flow into the stacking-type header 2.

<Action of Heat Exchanger>

Now, an action of the heat exchanger according to Embodiment 1 is described.

The flow passage 23A of the third plate-shaped member 23 is smaller in difference in flow resistance between the first flow passage 23*g* and the second flow passage 23*h* than that in the state in which the flow-passage resistances in the first flow passage 23*g* and the second flow passage 23*h* are equal to each other, and in a state in which the first flow passage 23*g* and the second flow passage 23*h* are point symmetric with each other about the opening port 23*f*. Therefore, the flow rate of the refrigerant flowing out from the end portion 23*a* and the flow rate of the refrigerant flowing out from the end portion 23*b* are equalized, which improves the uniformity in distribution of the refrigerant in the stacking-type header 2.

Further, the flow passage 23A formed in the third plate-shaped member 23 is a through groove, and the branching flow passage 12*b* is formed by stacking the third plate-shaped member 23. Therefore, the processing and assembly are simplified, and the production efficiency, the manufacturing cost, and the like are reduced.

In particular, even when the heat exchanger 1 is used in an inclined manner, in other words, even when the array direction of the first outlet flow passages 11A intersects with the gravity direction, the flow rate of the refrigerant flowing out from the end portion 23*a* and the flow rate of the refrigerant flowing out from the end portion 23*b* are equalized. Therefore, the uniformity in distribution of the refrigerant in the stacking-type header 2 is improved.

In particular, in the related-art stacking-type header, when the refrigerant flowing therein is in a two-phase gas-liquid state, the refrigerant is easily affected by the gravity, and it is difficult to equalize the flow rate and the quality of the refrigerant flowing into each heat transfer tube. In the stacking-type header 2, however, regardless of the flow rate and the quality of the refrigerant in the two-phase gas-liquid state flowing therein, the refrigerant is less liable to be affected by the gravity, and the flow rate and the quality of the refrigerant flowing into each first heat transfer tube 4 can be equalized.

In particular, in the related-art stacking-type header, when the heat transfer tube is changed from a circular tube to a flat tube for the purpose of reducing the refrigerant amount or achieving space saving in the heat exchanger, the stacking-type header is required to be upsized in the entire peripheral direction perpendicular to the refrigerant inflow direction. On the other hand, the stacking-type header 2 is not required to be upsized in the entire peripheral direction perpendicular to the refrigerant inflow direction, and thus space saving is achieved in the heat exchanger 1. In other words, in the related-art stacking-type header, when the heat transfer tube is changed from a circular tube to a flat tube, the sectional area of the flow passage in the heat transfer tube is reduced, and thus the pressure loss caused in the heat transfer tube is increased. Therefore, it is necessary to further reduce the angular interval between the plurality of grooves forming the branching flow passage to increase the number of paths (in other words, the number of heat transfer tubes), which causes upsize of the stacking-type header in the entire peripheral direction perpendicular to the refrigerant inflow direction. On the other hand, in the stacking-type header 2, even when the number of paths is required to be increased, the number of the third plate-shaped members 23 is only required to be increased, and hence the upsize of the stacking-type header 2 in the entire peripheral direction perpendicular to the refrigerant inflow direction is suppressed. Note that, the stacking-type header 2 is not limited to the case where the first heat transfer tube 4 is a flat tube.

Modified Example-1

Figure 18:
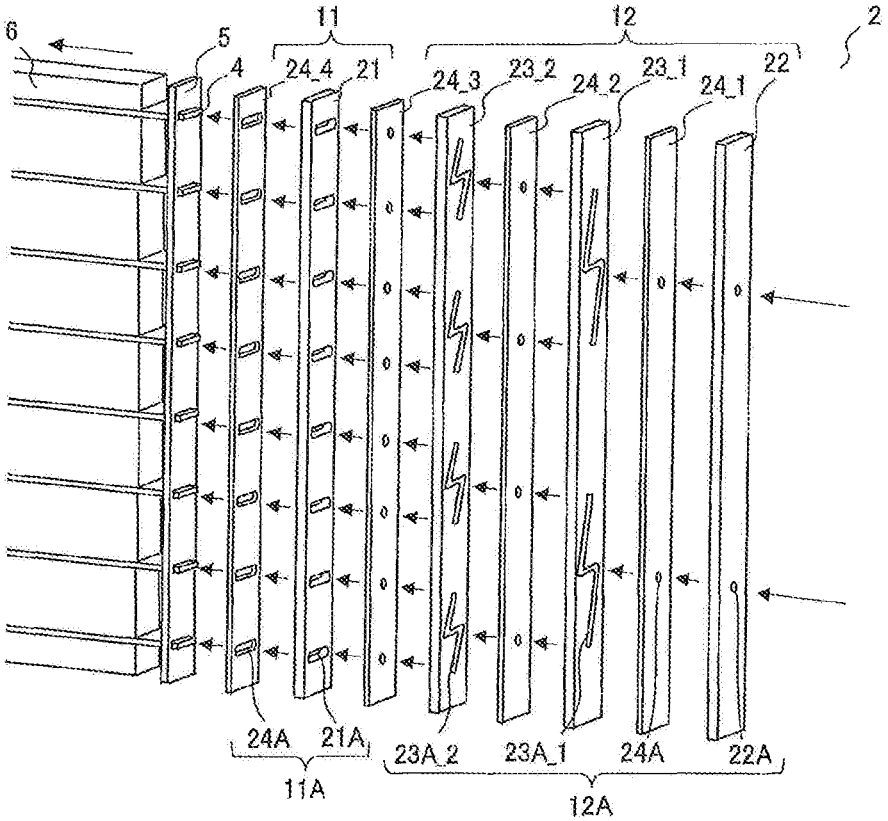
FIG. 18 is a perspective view of Modified Example-1 of the heat exchanger according to Embodiment 1 under a state in which the stacking-type header is disassembled.

FIG. 18 is a perspective view of Modified Example-1 of the heat exchanger according to Embodiment 1 under a state in which the stacking-type header is disassembled. Note that, in FIG. 18 and subsequent figures, a state in which the both-side clad member 24 is stacked is illustrated (state of FIG. 6 and FIG. 7), but it is needless to say that a state in which the both-side clad member 24 is not stacked (state of FIG. 2 and FIG. 3) may be employed.

As illustrated in FIG. 18, the second plate-shaped member 22 may have the plurality of flow passages 22A formed therein, in other words, the second plate-shaped unit 12 may have the plurality of first inlet flow passages 12*a* formed therein, to thereby reduce the number of the third plate-shaped members 23. With such a configuration, the component cost, the weight, and the like can be reduced.

Figure 19:
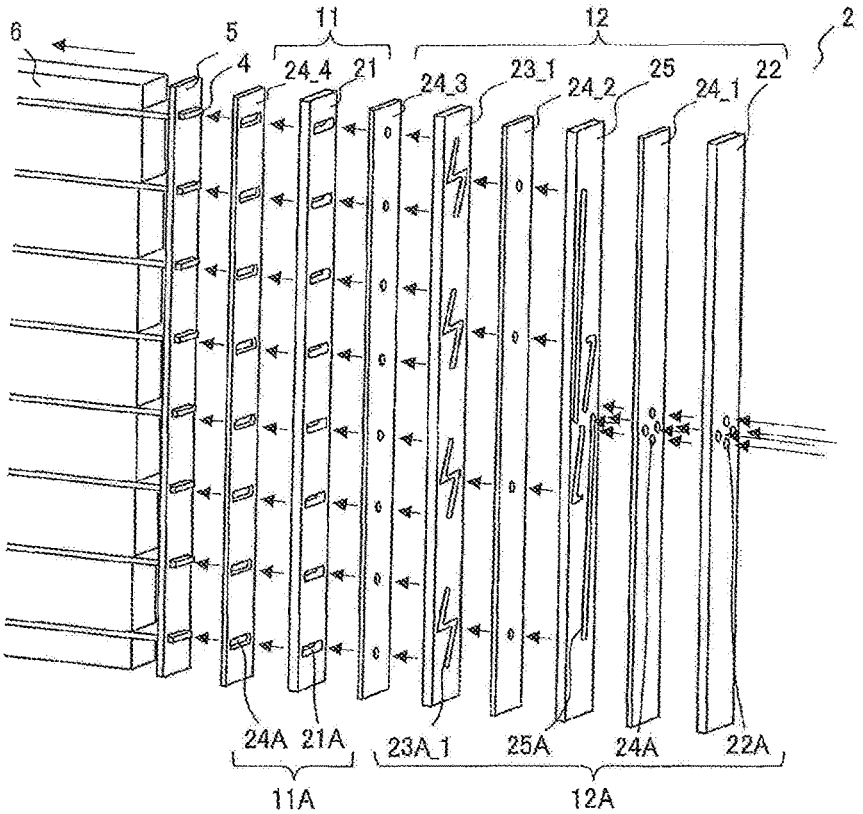
FIG. 19 is a perspective view of Modified Example-1 of the heat exchanger according to Embodiment 1 under a state in which the stacking-type header is disassembled.

FIG. 19 is a perspective view of Modified Example-1 of the heat exchanger according to Embodiment 1 under a state in which the stacking-type header is disassembled.

The plurality of flow passages 22A may not be formed in regions opposed to refrigerant inflow regions of the flow passages 23A formed in the third plate-shaped member 23. As illustrated in FIG. 9, for example, the plurality of flow passages 22A may be formed collectively at one position, and a flow passage 25A of a different plate-shaped member 25 stacked between the second plate-shaped member 22 and the third plate-shaped member 23_1 may guide each of the flows of the refrigerant passing through the plurality of flow passages 22A to a region opposed to the refrigerant inflow region of the flow passage 23A formed in the third plate-shaped member 23.

Modified Example-2

Figure 20:
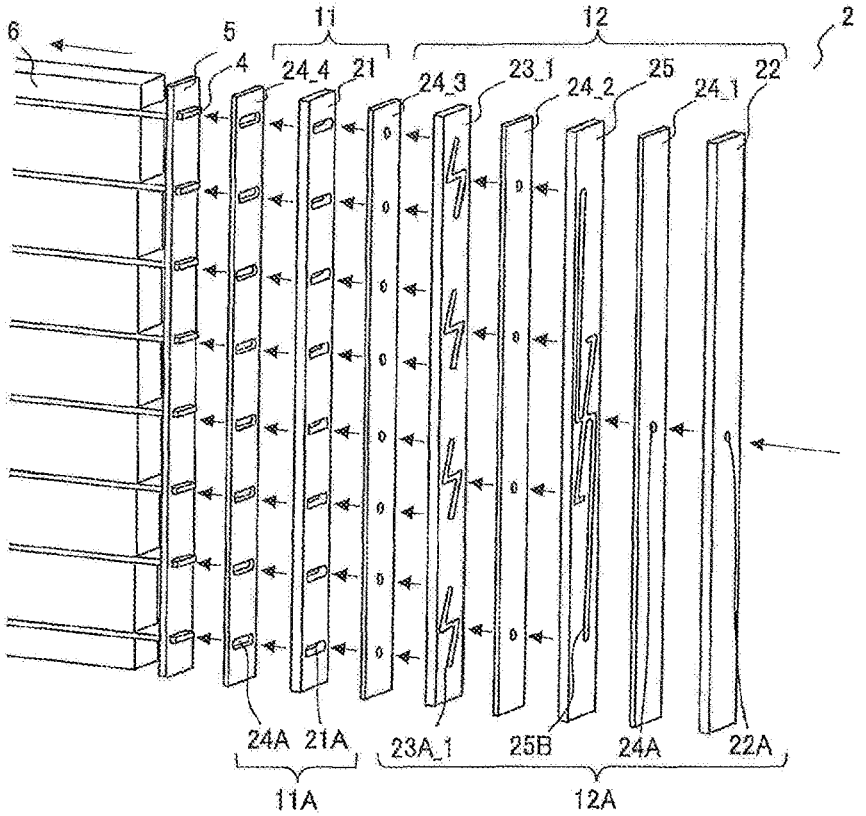
FIG. 20 is a perspective view of Modified Example-2 of the heat exchanger according to Embodiment 1 under a state in which the stacking-type header is disassembled.

FIG. 20 is a perspective view of Modified Example-2 of the heat exchanger according to Embodiment 1 under a state in which the stacking-type header is disassembled.

As illustrated in FIG. 20, any one of the third plate-shaped members 23 may be replaced by a different plate-shaped member 25 having a flow passage 25B whose opening port 23*f* is not positioned in the straight-line part 23*c*. For example, in the flow passage 25B, the opening port 23*f* is not positioned in the straight-line part 23*c* but positioned in an intersecting part, and the refrigerant flows into the intersecting part to be branched into four flows. The number of branches may be any number. As the number of branches is increased, the number of the third plate-shaped members 23 is reduced. With such a configuration, the uniformity in distribution of the refrigerant is reduced, but the component cost, the weight, and the like are reduced.

Modified Example-3

Figure 21:
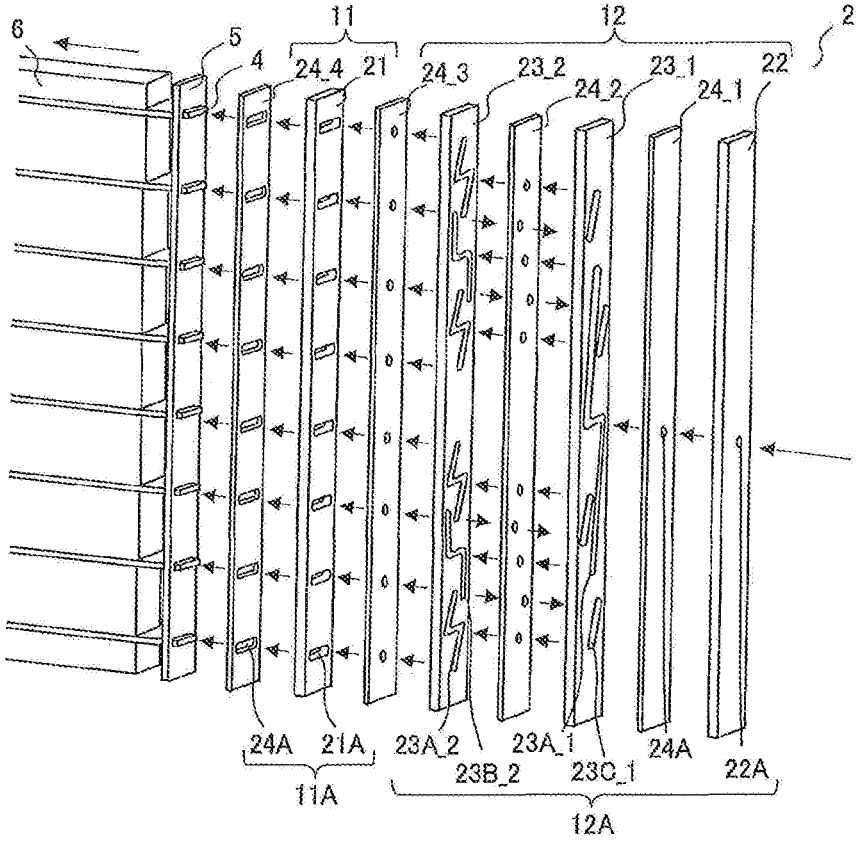
FIG. 21 is a perspective view of Modified Example-3 of the heat exchanger according to Embodiment 1 under a state in which the stacking-type header is disassembled.
Figure 22:
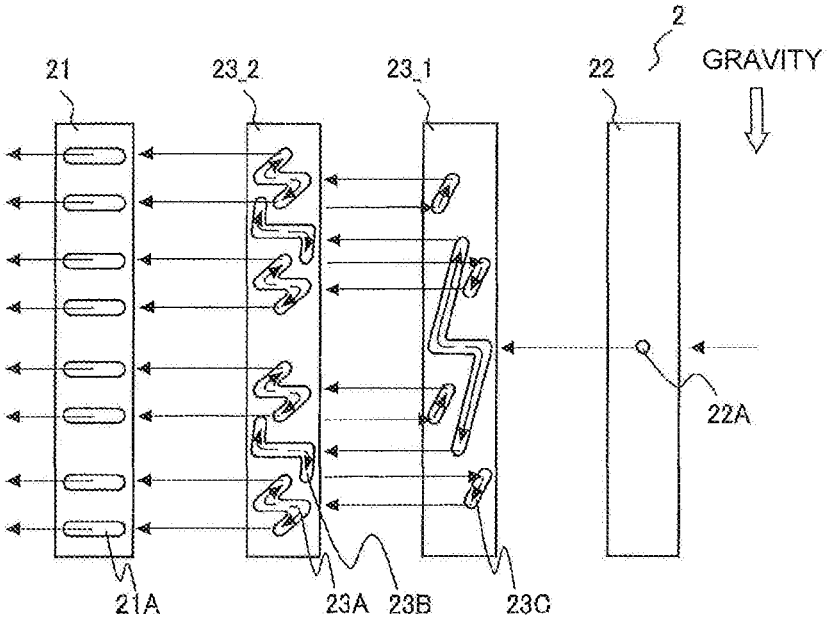
FIG. 22 is a developed view of the stacking-type header of Modified Example-3 of the heat exchanger according to Embodiment 1.

FIG. 21 is a perspective view of Modified Example-3 of the heat exchanger according to Embodiment 1 under a state in which the stacking-type header is disassembled. FIG. 22 is a developed view of the stacking-type header of Modified Example-3 of the heat exchanger according to Embodiment 1. Note that, in FIG. 22, the illustration of the both-side clad member 24 is omitted.

As illustrated in FIG. 21 and FIG. 22, any one of the third plate-shaped members 23 (for example, the third plate-shaped member 23_2) may include the flow passage 23A functioning as the branching flow passage 12*b* for causing the refrigerant to flow out therefrom to the side on which the first plate-shaped unit 11 is present without turning back the refrigerant, and a flow passage 23B functioning as a branching flow passage 12*b* for causing the refrigerant to flow out therefrom by turning back the refrigerant to a side opposite to the side on which the first plate-shaped unit 11 is present. The flow passage 23B has a configuration similar to that of the flow passage 23A. In other words, the flow passage 23B includes the straight-line part 23*c* perpendicular to the gravity direction, and the refrigerant flows therein through the opening port 23*f* formed between the end portion 23*d* and the end portion 23*e* of the straight-line part 23*c*, passes through each of the end portion 23*d* and the end portion 23*e*, and flows out therefrom through each of the end portions 23*a* and 23*b* of the flow passage 23B. With such a configuration, the number of the third plate-shaped members 23 is reduced, and the component cost, the weight, and the like are reduced. Further, the frequency of occurrence of brazing failure is reduced.

The third plate-shaped member 23 (for example, the third plate-shaped member 23_1) stacked on the third plate-shaped member 23 having the flow passage 23B formed therein on the side opposite to the side on which the first plate-shaped unit 11 is present may include a flow passage 23C for returning the refrigerant flowing therein through the flow passage 23B to the flow passage 23A of the third plate-shaped member 23 having the flow passage 23B formed therein without branching the refrigerant, or may include the flow passage 23A for returning the refrigerant while branching the refrigerant.

Modified Example-4

Figure 23:
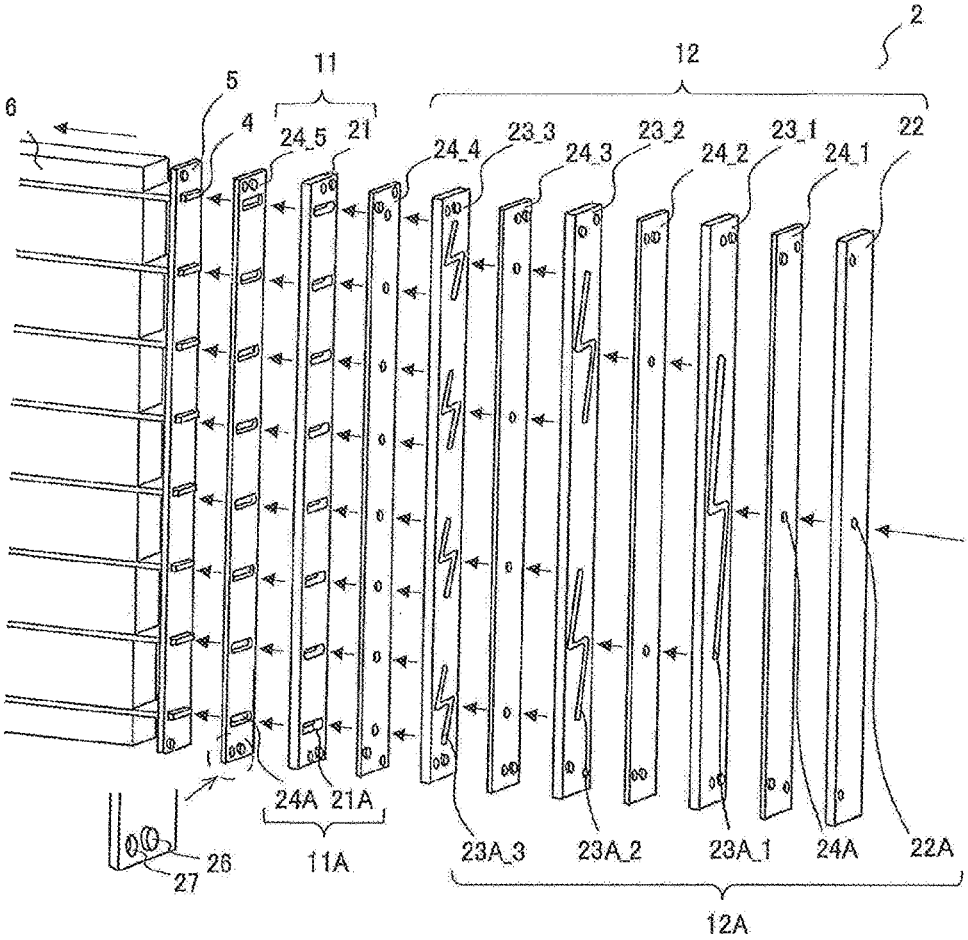
FIG. 23 is a perspective view of Modified Example-4 of the heat exchanger according to Embodiment 1 under a state in which the stacking-type header is disassembled.

FIG. 23 is a perspective view of Modified Example-4 of the heat exchanger according to Embodiment 1 under a state in which the stacking-type header is disassembled.

As illustrated in FIG. 23, a convex portion 26 may be formed on any one of the plate-shaped member and the both-side clad member 24, in other words, a surface of any one of the members to be stacked. For example, the position, shape, size, and the like of the convex portion 26 are specific to each member to be stacked. The convex portion 26 may be a component such as a spacer. The member stacked adjacent thereto has a concave portion 27 formed therein, into which the convex portion 26 is inserted. The concave portion 27 may be or not be a through hole. With such a configuration, the error in lamination order of the members to be stacked is suppressed, which reduces the failure rate. The convex portion 26 and the concave portion 27 may be fitted to each other. In such a case, a plurality of convex portions 26 and a plurality of concave portions 27 may be formed so that the members to be stacked are positioned through the fitting. Further, the concave portion 27 may not be formed, and the convex portion 26 may be fit into a part of the flow passage of the member stacked adjacent thereto. In such a case, the height, size, and the like of the convex portion 26 may be set to levels that do not inhibit the flow of the refrigerant.

Modified Example-5

Figure 24:
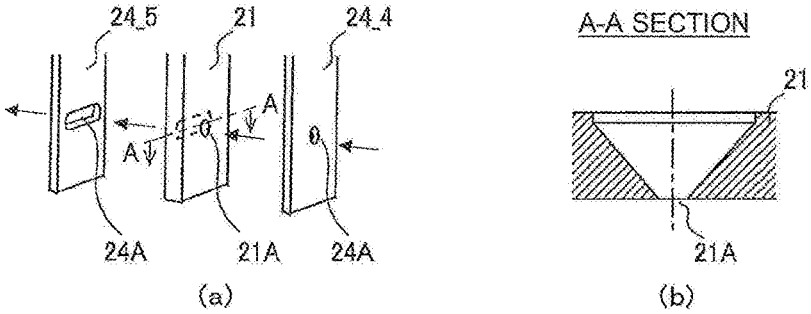
FIG. 24 are a main-part perspective view and a main-part sectional view of Modified Example-5 of the heat exchanger according to Embodiment 1 under a state in which the stacking-type header is disassembled.

FIG. 24 are a main-part perspective view and a main-part sectional view of Modified Example-5 of the heat exchanger according to Embodiment 1 under a state in which the stacking-type header is disassembled. Note that, FIG. 24(*a*) is a main-part perspective view under the state in which the stacking-type header is disassembled, and FIG. 24(*b*) is a sectional view of the first plate-shaped member 21 taken along the line A-A of FIG. 24(*a*).

As illustrated in FIG. 24, any one of the plurality of flow passages 21A formed in the first plate-shaped member 21 may be a tapered through hole having a circular shape at the surface of the first plate-shaped member 21 on the side on which the second plate-shaped unit 12 is present, and having a shape conforming to the outer peripheral surface of the first heat transfer tube 4 at the surface of the first plate-shaped member 21 on the side on which the retaining member 5 is present. In particular, when the first heat transfer tube 4 is a flat tube, the through hole is shaped to gradually expand in a region from the surface on the side on which the second plate-shaped unit 12 is present to the surface on the side on which the retaining member 5 is present. With such a configuration, the pressure loss of the refrigerant when the refrigerant passes through the first outlet flow passage 11A is reduced.

Modified Example-6

Figure 25:
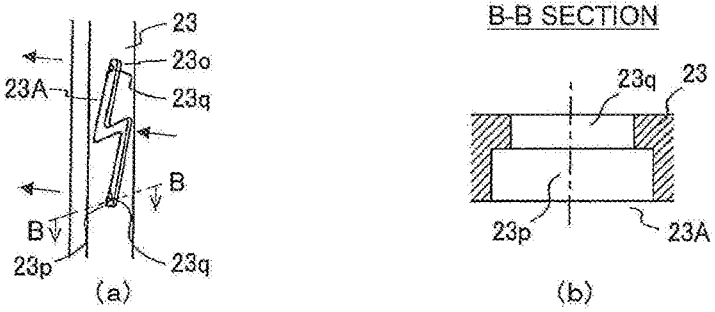
FIG. 25 are a main-part perspective view and a main-part sectional view of Modified Example-6 of the heat exchanger according to Embodiment 1 under a state in which the stacking-type header is disassembled.

FIG. 25 are a main-part perspective view and a main-part sectional view of Modified Example-6 of the heat exchanger according to Embodiment 1 under a state in which the stacking-type header is disassembled. Note that, FIG. 25(*a*) is a main-part perspective view under the state in which the stacking-type header is disassembled, and FIG. 25(*b*) is a sectional view of the third plate-shaped member 23 taken along the line B-B of FIG. 25(*a*).

As illustrated in FIG. 25, any one of the flow passages 23A formed in the third plate-shaped member 23 may be a bottomed groove. In such a case, a circular through hole 23*q* is formed at each of an end portion 23*o* and an end portion 23*p* of a bottom surface of the groove of the flow passage 23A. With such a configuration, the both-side clad member 24 is not required to be stacked between the plate-shaped members in order to interpose the flow passage 24A functioning as the refrigerant partitioning flow passage between the branching flow passages 12*b*, which improves the production efficiency. Note that, in FIG. 25, there is illustrated a case where the refrigerant outflow side of the flow passage 23A is the bottom surface, but the refrigerant inflow side of the flow passage 23A may be the bottom surface. In such a case, a through hole may be formed in a region corresponding to the opening port 23*f*.

Figure 26:
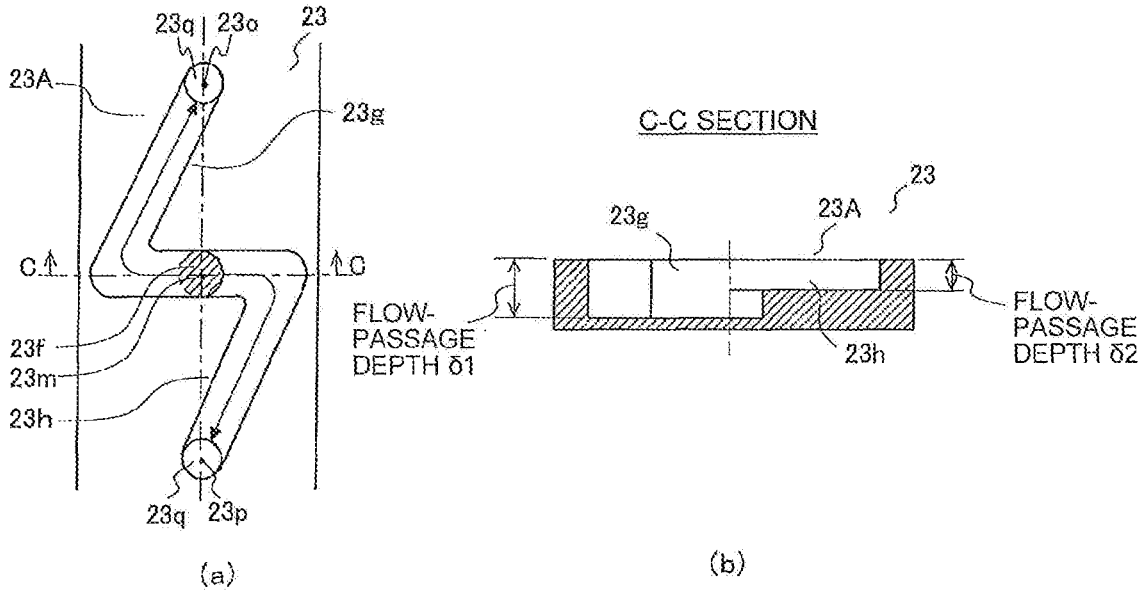
FIG. 26 are views each illustrating a specific example of the flow passage formed in the third plate-shaped member of Modified Example-6 of the heat exchanger according to Embodiment 1.

FIG. 26 are views each illustrating a specific example of the flow passage formed in the third plate-shaped member of Modified Example-6 of the heat exchanger according to Embodiment 1. Note that, FIG. 26(*b*) is a sectional view of the third plate-shaped member 23 taken along the line C-C of FIG. 26(*a*).

As illustrated in FIG. 26, in the flow passage 23A, the flow-passage depth 52 of the second flow passage 23*h* is smaller than the flow-passage depth δ1 of the first flow passage 23*g*. In such a case, the flow-passage resistance in the second flow passage 23*h* is larger than the flow-passage resistance in the first flow passage 23*g*, thereby suppressing the increase in flow rate of the refrigerant flowing into the second flow passage 23*h* due to the influence of the gravity. Effects of Modified Example-6 are the same as those obtained by changing the horizontal axis of FIG. 9 to δ1/δ2. Note that, the flow passage 23A may have a mode similar to those of Specific Example 1 to Specific Example 6. Further, setting the flow-passage depth δ2 of the second flow passage 23*h* smaller than the flow-passage depth δ1 of the first flow passage 23*g* and may be combined with the modes of Specific Example 1 to Specific Example 6.

Setting the flow-passage depth δ2 of the second flow passage 23*h* smaller than the flow-passage depth δ1 of the first flow passage 23*g* may be realized by forming only the first flow passage 23*g* into a through groove. Further, the first flow passage 23*g* and the second flow passage 23*h* may be formed into through grooves, and a member for filling a part of the through groove in a depth direction may be fit only into the second flow passage 23*h*. The member may be the convex portion formed on the member stacked adjacent to the third plate-shaped member.

Modified Example-7

Figure 27:
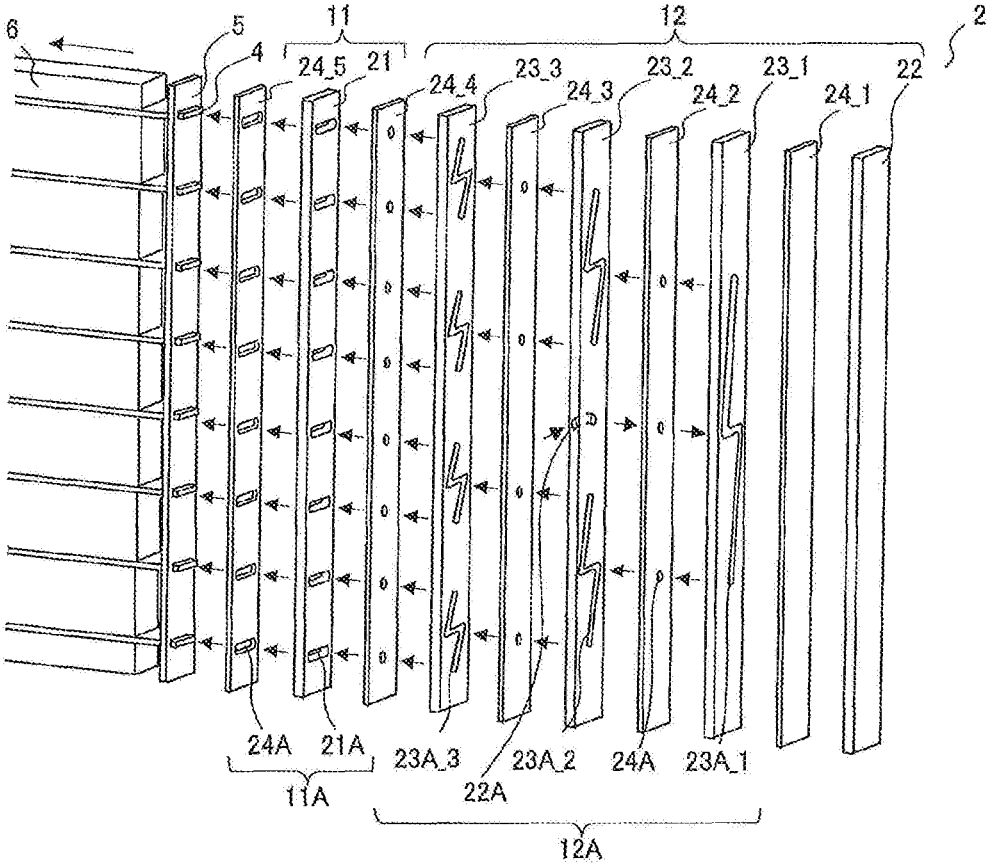
FIG. 27 is a perspective view of Modified Example-7 of the heat exchanger according to Embodiment 1 under a state in which the stacking-type header is disassembled.

FIG. 27 is a perspective view of Modified Example-7 of the heat exchanger according to Embodiment 1 under a state in which the stacking-type header is disassembled.

As illustrated in FIG. 27, the flow passage 22A functioning as the first inlet flow passage 12*a* may be formed in a member to be stacked other than the second plate-shaped member 22, in other words, a different plate-shaped member, the both-side clad member 24, or other members. In such a case, the flow passage 22A may be formed as, for example, a through hole passing through the different plate-shaped member from the side surface thereof to the surface on the side on which the second plate-shaped member 22 is present. In other words, the present invention encompasses a configuration in which the first inlet flow passage 12*a* is formed in the first plate-shaped unit 11, and the "distribution flow passage" of the present invention encompasses distribution flow passages other than the distribution flow passage 12A in which the first inlet flow passage 12*a* is formed in the second plate-shaped unit 12.

Embodiment 2

A heat exchanger according to Embodiment 2 is described.

Note that, overlapping description or similar description to that of Embodiment 1 is appropriately simplified or omitted.

<Configuration of Heat Exchanger>

Now, the configuration of the heat exchanger according to Embodiment 2 is described.

Figure 28:
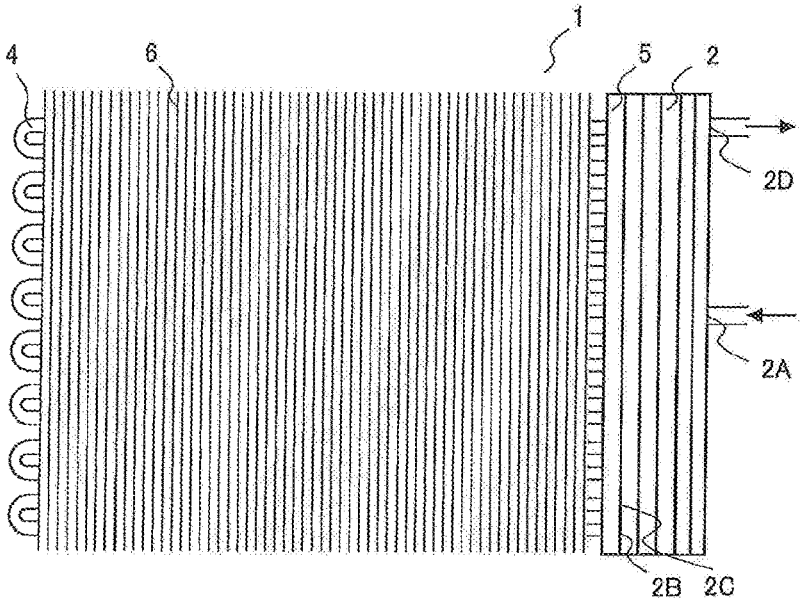
FIG. 28 is a view illustrating a configuration of a heat exchanger according to Embodiment 2.

FIG. 28 is a view illustrating the configuration of the heat exchanger according to Embodiment 2.

As illustrated in FIG. 28, the heat exchanger 1 includes the stacking-type header 2, the plurality of first heat transfer tubes 4, the retaining member 5, and the plurality of fins 6.

The stacking-type header 2 includes the refrigerant inflow port 2A, the plurality of refrigerant outflow ports 2B, a plurality of refrigerant inflow ports 2C, and a refrigerant outflow port 2D. The refrigerant pipes are connected to the refrigerant inflow port 2A of the stacking-type header 2 and the refrigerant outflow port 2D of the stacking-type header 2. The first heat transfer tube 4 is a flat tube subjected to hair-pin bending. The plurality of first heat transfer tubes 4 are connected between the plurality of refrigerant outflow ports 2B of the stacking-type header 2 and the plurality of refrigerant inflow ports 2C of the stacking-type header 2.

<Flow of Refrigerant in Heat Exchanger>

Now, the flow of the refrigerant in the heat exchanger according to Embodiment 2 is described.

The refrigerant flowing through the refrigerant pipe passes through the refrigerant inflow port 2A to flow into the stacking-type header 2 to be distributed, and then passes through the plurality of refrigerant outflow ports 2B to flow out toward the plurality of first heat transfer tubes 4. In the plurality of first heat transfer tubes 4, the refrigerant exchanges heat with air supplied by a fan, for example. The refrigerant passing through the plurality of first heat transfer tubes 4 passes through the plurality of refrigerant inflow ports 2C to flow into the stacking-type header 2 to be joined, and then passes through the refrigerant outflow port 2D to flow out toward the refrigerant pipe. The refrigerant can reversely flow.

<Configuration of Laminated Header>

Now, the configuration of the stacking-type header of the heat exchanger according to Embodiment 2 is described.

Figure 29:
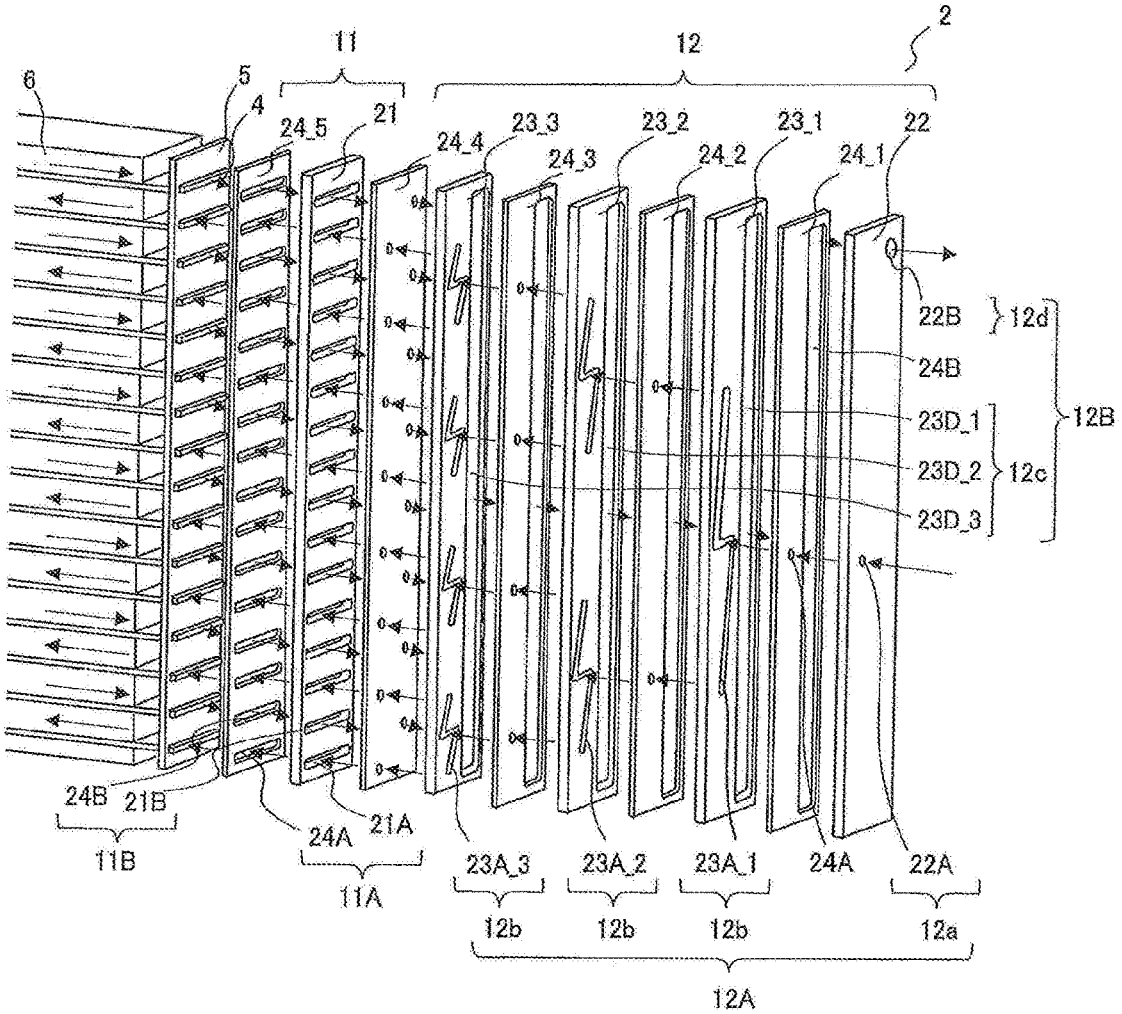
FIG. 29 is a perspective view illustrating the heat exchanger according to Embodiment 2 under a state in which a stacking-type header is disassembled.
Figure 30:
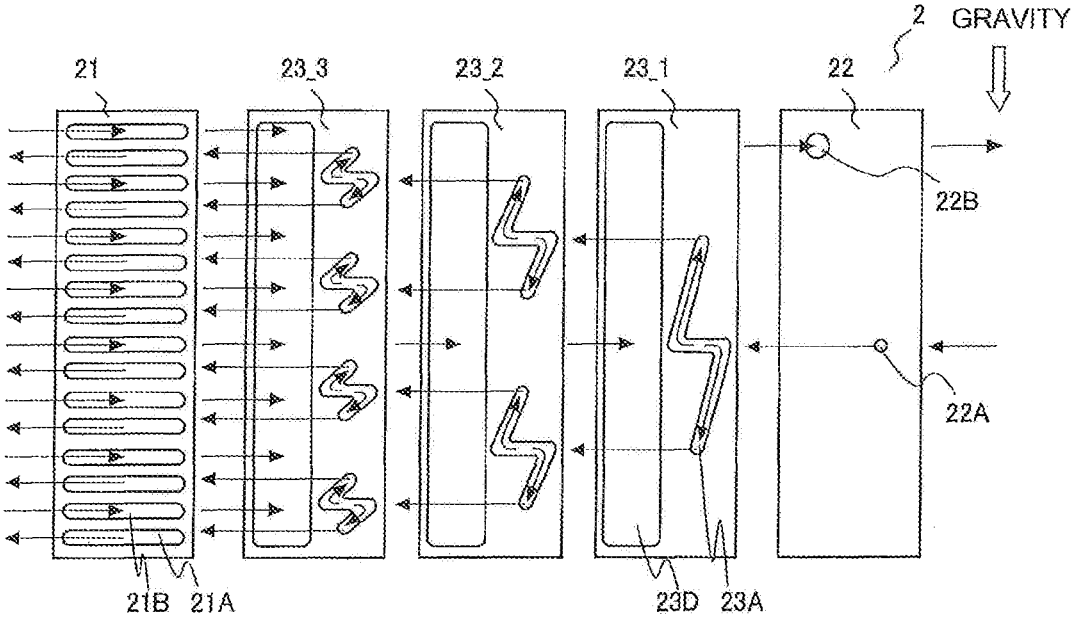
FIG. 30 is a developed view of the stacking-type header of the heat exchanger according to Embodiment 2.

FIG. 29 is a perspective view of the heat exchanger according to Embodiment 2 under a state in which the stacking-type header is disassembled. FIG. 30 is a developed view of the stacking-type header of the heat exchanger according to Embodiment 2. Note that, in FIG. 30, the illustration of the both-side clad member 24 is omitted.

As illustrated in FIG. 29 and FIG. 30, the stacking-type header 2 includes the first plate-shaped unit 11 and the second plate-shaped unit 12. The first plate-shaped unit 11 and the second plate-shaped unit 12 are stacked on each other.

The first plate-shaped unit 11 has the plurality of first outlet flow passages 11A and a plurality of second inlet flow passages 113 formed therein. The plurality of second inlet flow passages 11B correspond to the plurality of refrigerant inflow ports 2C in FIG. 28.

The first plate-shaped member 21 has a plurality of flow passages 21B formed therein. The plurality of flow passages 21B are each a through hole having an inner peripheral surface shaped conforming to an outer peripheral surface of the first heat transfer tube 4. When the first plate-shaped member 21 is stacked, the plurality of flow passages 21B function as the plurality of second inlet flow passages 11B.

The second plate-shaped unit 12 has the distribution flow passage 12A and a joining flow passage 12B formed therein. The joining flow passage 12B includes a mixing flow passage 12*c* and a second outlet flow passage 12*d*. The second outlet flow passage 12*d* corresponds to the refrigerant outflow port 2D in FIG. 28.

The second plate-shaped member 22 has a flow passage 22B formed therein. The flow passage 22B is a circular through hole. When the second plate-shaped member 22 is stacked, the flow passage 22B functions as the second outlet flow passage 12*d*. Note that, a plurality of flow passages 22B, in other words, a plurality of second outlet flow passages 12*d* may be formed.

The plurality of third plate-shaped members 23_1 to 23_3 respectively have a plurality of flow passages 23D_1 to 23D_3 formed therein. The plurality of flow passages 23D_1 to 23D_3 are each a rectangular through hole passing through substantially the entire region in the height direction of the third plate-shaped member 23. When the plurality of third plate-shaped members 23_1 to 23_3 are stacked, each of the flow passages 23D_1 to 23D_3 functions as the mixing flow passage 12*c*. The plurality of flow passages 23D_1 to 23D_3 may not have a rectangular shape. In the following, in some cases, the plurality of flow passages 23D_1 to 23D_3 may be collectively referred to as the flow passage 23D.

In particular, it is preferred to stack the both-side clad member 24 having a brazing material rolled on both surfaces thereof between the respective plate-shaped members to supply the brazing material. The flow passage 24B formed in the both-side clad member 24_5 stacked between the retaining member 5 and the first plate-shaped member 21 is a through hole having an inner peripheral surface shaped conforming to the outer peripheral surface of the first heat transfer tube 4. The flow passage 24B formed in the both-side clad member 24_4 stacked between the first plate-shaped member 21 and the third plate-shaped member 23_3 is a circular through hole. The flow passage 24B formed in other both-side clad members 24 stacked between the third plate-shaped member 23 and the second plate-shaped member 22 is a rectangular through hole passing through substantially the entire region in the height direction of the both-side clad member 24. When the both-side clad member 24 is stacked, the flow passage 24B functions as the refrigerant partitioning flow passage for the second inlet flow passage 11B and the joining flow passage 12B.

Note that, the flow passage 22B functioning as the second outlet flow passage 12*d* may be formed in a different plate-shaped member other than the second plate-shaped member 22 of the second plate-shaped unit 12, the both-side clad member 24, or other members. In such a case, a notch may be formed, which communicates between a part of the flow passage 23D or the flow passage 24B and, for example, a side surface of the different plate-shaped member or the both-side clad member 24. The mixing flow passage 12*c* may be turned back so that the flow passage 22B functioning as the second outlet flow passage 12*d* is formed in the first plate-shaped member 21. In other words, the present invention encompasses a configuration in which the second outlet flow passage 12*d* is formed in the first plate-shaped unit 11, and the "joining flow passage" of the present invention encompasses joining flow passages other than the joining flow passage 12B in which the second outlet flow passage 12*d* is formed in the second plate-shaped unit 12.

<Flow of Refrigerant in Laminated Header>

Now, the flow of the refrigerant in the stacking-type header of the heat exchanger according to Embodiment 2 is described.

As illustrated in FIG. 29 and FIG. 30, the refrigerant owing out from the flow passage 21A of the first plate-shaped member 21 to pass through the first heat transfer tube 4 flows into the flow passage 21B of the first plate-shaped member 21. The refrigerant flowing into the flow passage 21B of the first plate-shaped member 21 flows into the flow passage 23D formed in the third plate-shaped member 23 to be mixed. The mixed refrigerant passes through the flow passage 22B of the second plate-shaped member 22 to flow out therefrom toward the refrigerant pipe.

<Usage Mode of Heat Exchanger>

Now, an example of a usage mode of the heat exchanger according to Embodiment 2 is described.

Figure 31:
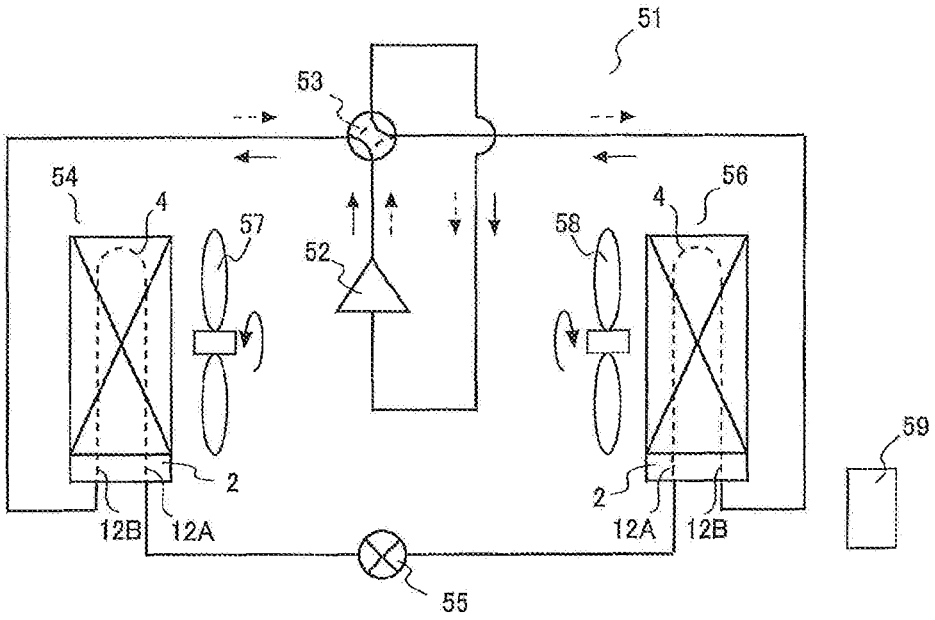
FIG. 31 is a diagram illustrating a configuration of an air-conditioning apparatus to which the heat exchanger according to Embodiment 2 is applied.

FIG. 31 is a diagram illustrating a configuration of an air-conditioning apparatus to which the heat exchanger according to Embodiment 2 is applied.

As illustrated in FIG. 31, the heat exchanger 1 is used for at least one of the heat source-side heat exchanger 54 or the load-side heat exchanger 56. When the heat exchanger 1 acts as the evaporator, the heat exchanger 1 is connected so that the refrigerant passes through the distribution flow passage 12A of the stacking-type header 2 to flow into the first heat transfer tube 4, and the refrigerant passes through the first heat transfer tube 4 to flow into the joining flow passage 12B of the stacking-type header 2. In other words, when the heat exchanger 1 acts as the evaporator, the refrigerant in a two-phase gas-liquid state passes through the refrigerant pipe to flow into the distribution flow passage 12A of the stacking-type header 2, and the refrigerant in a gas state passes through the first heat transfer tube 4 to flow into the joining flow passage 12B of the stacking-type header 2. Further, when the heat exchanger 1 acts as the condensor, the refrigerant in a gas state passes through the refrigerant pipe to flow into the joining flow passage 12B of the stacking-type header 2, and the refrigerant in a liquid state passes through the first heat transfer tube 4 to flow into the distribution flow passage 12A of the stacking-type header 2.

<Action of Heat Exchanger>

Now, the action of the heat exchanger according to Embodiment 2 is described.

In the stacking-type header 2, the first plate-shaped unit 11 has the plurality of second inlet flow passages 11B formed therein, and the second plate-shaped unit 12 has the joining flow passage 12B formed therein. Therefore, the header 3 is unnecessary, and thus the component cost and the like of the heat exchanger 1 are reduced. Further, the header 3 is unnecessary, and accordingly, it is possible to extend the first heat transfer tube 4 to increase the number of the fins 6 and the like, in other words, increase the mounting volume of the heat exchanging unit of the heat exchanger 1.

Embodiment 3

A heat exchanger according to Embodiment 3 is described.

Note that, overlapping description or similar description to that of each of Embodiment 1 and Embodiment 2 is appropriately simplified or omitted.

<Configuration of Heat Exchanger>

Now, the configuration of the heat exchanger according to Embodiment 3 is described.

Figure 32:
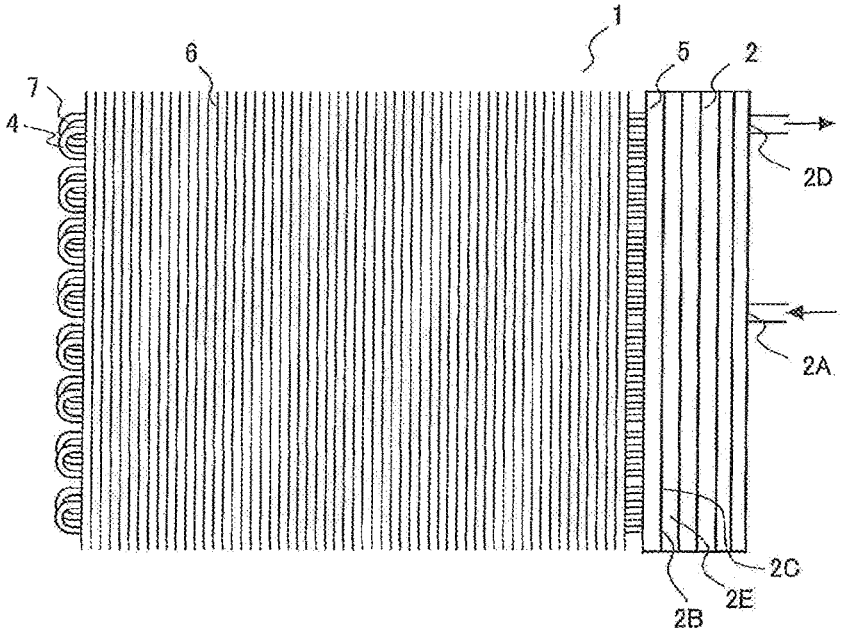
FIG. 32 is a view illustrating a configuration of a heat exchanger according to Embodiment 3.

FIG. 32 is a view illustrating the configuration of the heat exchanger according to Embodiment 3.

As illustrated in FIG. 32, the heat exchanger 1 includes the stacking-type header 2, the plurality of first heat transfer tubes 4, a plurality of second heat transfer tubes 7, the retaining member 5, and the plurality of fins 6.

The stacking-type header 2 includes a plurality of refrigerant turn-back ports 2E. Similarly to the first heat transfer tube 4, the second heat transfer tube 7 is a flat tube subjected to hair-pin bending. The plurality of first heat transfer tubes 4 are connected between the plurality of refrigerant outflow ports 2B and the plurality of refrigerant turn-back ports 2E of the stacking-type header 2, and the plurality of second heat transfer tubes 7 are connected between the plurality of refrigerant turn-back ports 2E and the plurality of refrigerant inflow ports 2C of the stacking-type header 2.

<Flow of Refrigerant in Heat Exchanger>

Now, the flow of the refrigerant in the heat exchanger according to Embodiment 3 is described.

The refrigerant flowing through the refrigerant pipe passes through the refrigerant inflow port 2A to flow into the stacking-type header 2 to be distributed, and then passes through the plurality of refrigerant outflow ports 2B to flow out toward the plurality of first heat transfer tubes 4. In the plurality of first heat transfer tubes 4, the refrigerant exchanges heat with air supplied by a fan, for example. The refrigerant passing through the plurality of first heat transfer tubes 4 flows into the plurality of refrigerant turn-back ports 2E of the stacking-type header 2 to be turned back, and flows out therefrom toward the plurality of second heat transfer tubes 7. In the plurality of second heat transfer tubes 7, the refrigerant exchanges heat with air supplied by a fan, for example. The flows of the refrigerant passing through the plurality of second heat transfer tubes 7 pass through the plurality of refrigerant inflow ports 2C to flow into the stacking-type header 2 to be joined, and the joined refrigerant passes through the refrigerant outflow port 2D to flow out therefrom toward the refrigerant pipe. The refrigerant can reversely flow.

<Configuration of Laminated Header>

Now, the configuration of the stacking-type header of the heat exchanger according to Embodiment 3 is described.

Figure 33:
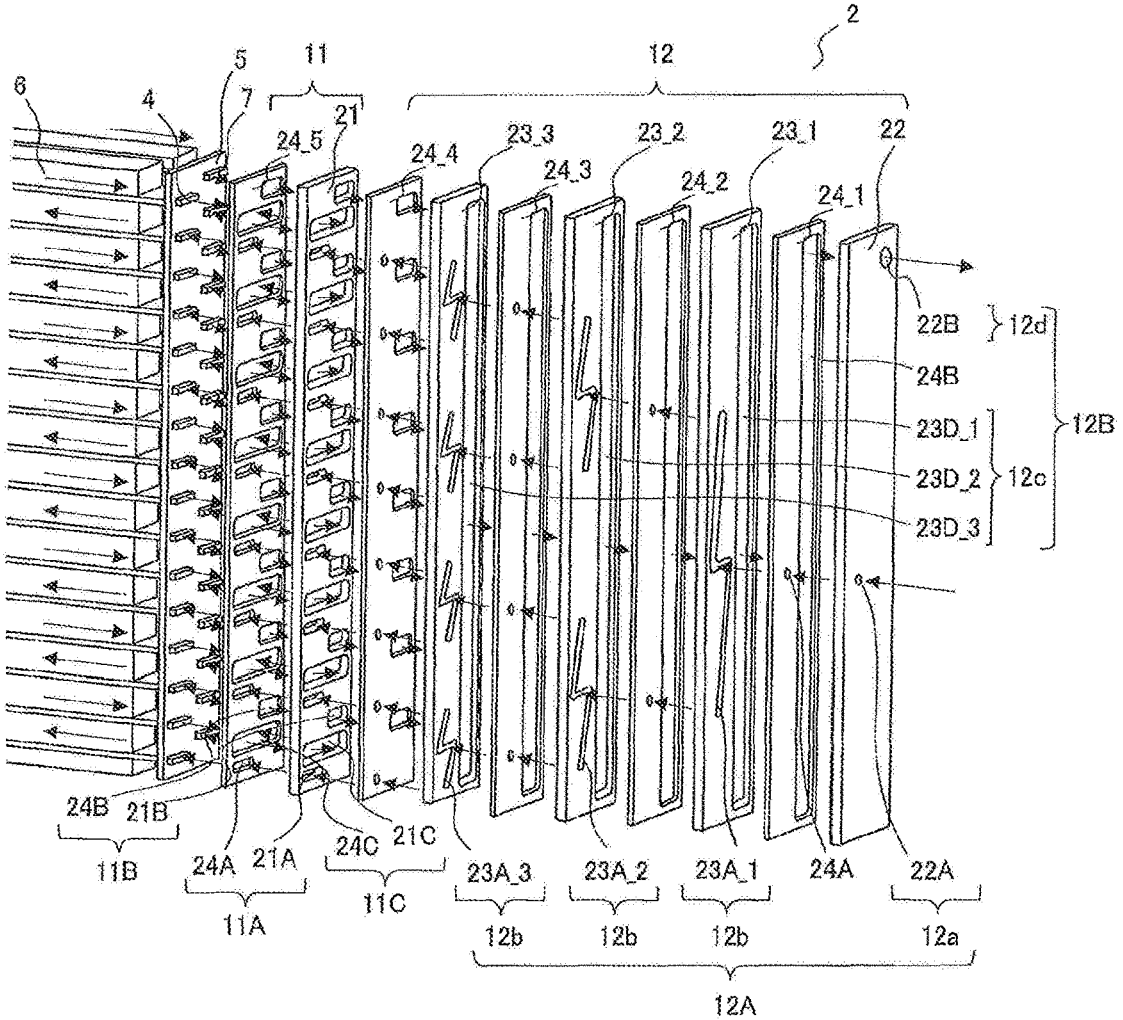
FIG. 33 is a perspective view illustrating the heat exchanger according to Embodiment 3 under a state in which a stacking-type header is disassembled.
Figure 34:
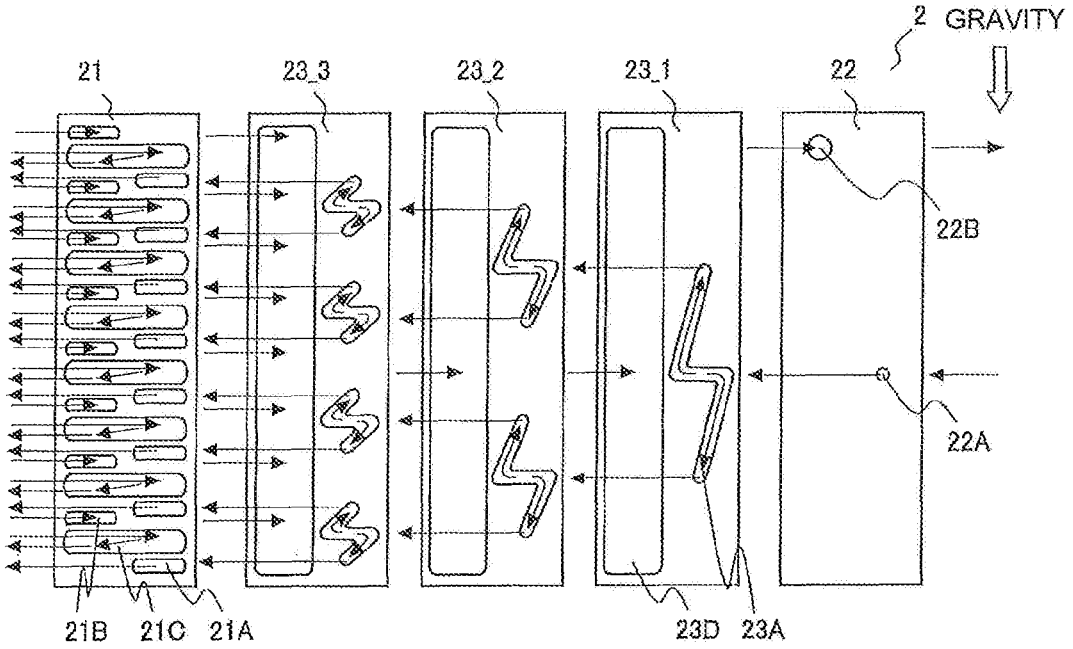
FIG. 34 is a developed view of the stacking-type header of the heat exchanger according to Embodiment 3.

FIG. 33 is a perspective view of the heat exchanger according to Embodiment 3 under a state in which the stacking-type header is disassembled. FIG. 34 is a developed view of the stacking-type header of the heat exchanger according to Embodiment 3. Note that, in FIG. 34, the illustration of the both-side clad member 24 is omitted.

As illustrated in FIG. 33 and FIG. 34, the stacking-type header 2 includes the first plate-shaped unit 11 and the second plate-shaped unit 12. The first plate-shaped unit 11 and the second plate-shaped unit 12 are stacked on each other.

The first plate-shaped unit 11 has the plurality of first outlet flow passages 11A, the plurality of second inlet flow passages 11B, and a plurality of turn-back flow passages 110 formed therein. The plurality of turn-back flow passages 110 correspond to the plurality of refrigerant turn-back ports 2E in FIG. 32.

The first plate-shaped member 21 has a plurality of flow passages 21C formed therein. The plurality of flow passages 21C are each a through hole having an inner peripheral surface shaped to surround the outer peripheral surface of the end portion of the first heat transfer tube 4 on the refrigerant outflow side and the outer peripheral surface of the end portion of the second heat transfer tube 7 on the refrigerant inflow side. When the first plate-shaped member 21 is stacked, the plurality of flow passages 21C function as the plurality of turn-back flow passages 110.

In particular, it is preferred to stack the both-side clad member 24 having a brazing material rolled on both surfaces thereof between the respective plate-shaped members to supply the brazing material. The flow passage 24C formed in the both-side clad member 24_5 stacked between the retaining member 5 and the first plate-shaped member 21 is a through hole having an inner peripheral surface shaped to surround the outer peripheral surface of the end portion of the first heat transfer tube 4 on the refrigerant outflow side and the outer peripheral surface of the end portion of the second heat transfer tube 7 on the refrigerant inflow side. When the both-side clad member 24 is stacked, the flow passage 240 functions as the refrigerant partitioning flow passage for the turn-back flow passage 110.

<Flow of Refrigerant in Laminated Header>

Now, the flow of the refrigerant in the stacking-type header of the heat exchanger according to Embodiment 3 is described.

As illustrated in FIG. 33 and FIG. 34, the refrigerant flowing out from the flow passage 21A of the first plate-shaped member 21 to pass through the first heat transfer tube 4 flows into the flow passage 21C of the first plate-shaped member 21 to be turned back and flow into the second heat transfer tube 7. The refrigerant passing through the second heat transfer tube 7 flows into the flow passage 21B of the first plate-shaped member 21. The refrigerant flowing into the flow passage 21B of the first plate-shaped member 21 flows into the flow passage 230 formed in the third plate-shaped member 23 to be mixed. The mixed refrigerant passes through the flow passage 22B of the second plate-shaped member 22 to flow out therefrom toward the refrigerant pipe.

<Usage Mode of Heat Exchanger>

Now, an example of a usage mode of the heat exchanger according to Embodiment 3 is described.

Figure 35:
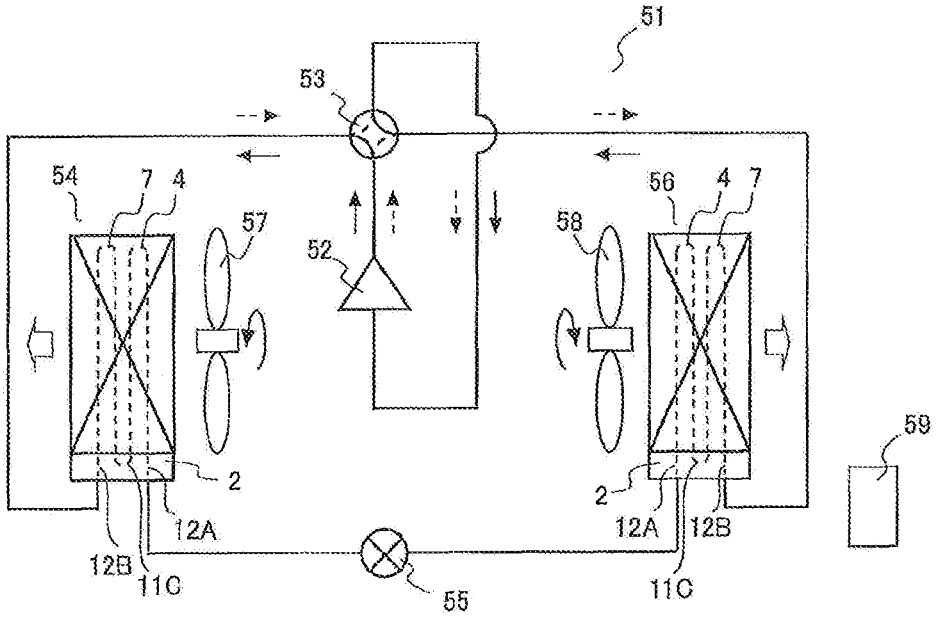
FIG. 35 is a diagram illustrating a configuration of an air-conditioning apparatus to which the heat exchanger according to Embodiment 3 is applied.

FIG. 35 is a diagram illustrating a configuration of an air-conditioning apparatus to which the heat exchanger according to Embodiment 3 is applied.

As illustrated in FIG. 35, the heat exchanger 1 is used for at least one of the heat source-side heat exchanger 54 or the load-side heat exchanger 56. When the heat exchanger 1 acts as the evaporator, the heat exchanger 1 is connected so that the refrigerant passes through the distribution flow passage 12A of the stacking-type header 2 to flow into the first heat transfer tube 4, and the refrigerant passes through the second heat transfer tube 7 to flow into the joining flow passage 12B of the stacking-type header 2. In other words, when the heat exchanger 1 acts as the evaporator, the refrigerant in a two-phase gas-liquid state passes through the refrigerant pipe to flow into the distribution flow passage 12A of the stacking-type header 2, and the refrigerant in a gas state passes through the second heat transfer tube 7 to flow into the joining flow passage 12B of the stacking-type header 2. Further, when the heat exchanger 1 acts as the condensor, the refrigerant in a gas state passes through the refrigerant pipe to flow into the joining flow passage 12B of the stacking-type header 2, and the refrigerant in a liquid state passes through the first heat transfer tube 4 to flow into the distribution flow passage 12A of the stacking-type header 2.

Further, when the heat exchanger 1 acts as the condensor, the heat exchanger 1 is arranged so that the first heat transfer tube 4 is positioned on the upstream side (windward side) of the air stream generated by the heat source-side fan 57 or the load-side fan 58 with respect to the second heat transfer tube 7. In other words, there is obtained a relationship that the flow of the refrigerant from the second heat transfer tube 7 to the first heat transfer tube 4 and the air stream are opposed to each other. The refrigerant of the first heat transfer tube 4 is lower in temperature than the refrigerant of the second heat transfer tube 7. The air stream generated by the heat source-side fan 57 or the load-side fan 58 is lower in temperature on the upstream side of the heat exchanger 1 than on the downstream side of the heat exchanger 1. As a result, in particular, the refrigerant can be subcooled (so-called subcooling) by the low-temperature air stream flowing on the upstream side of the heat exchanger 1, which improves the condensor performance. Note that, the heat source-side fan 57 and the load-side fan 58 may be arranged on the windward side or the leeward side.

<Action of Heat Exchanger>

Now, the action of the heat exchanger according to Embodiment 3 is described.

In the heat exchanger 1, the first plate-shaped unit 11 has the plurality of turn-back flow passages 110 formed therein, and in addition to the plurality of first heat transfer tubes 4, the plurality of second heat transfer tubes 7 are connected. For example, it is possible to increase the area in a state of the front view of the heat exchanger 1 to increase the heat exchange amount, but in this case, the housing that incorporates the heat exchanger 1 is upsized. Further, it is possible to decrease the interval between the fins 6 to increase the number of the fins 6, to thereby increase the heat exchange amount. In this case, however, from the viewpoint of drainage performance, frost formation performance, and anti-dust performance, it is difficult to decrease the interval between the fins 6 to less than about 1 mm, and thus the increase in heat exchange amount may be insufficient. On the other hand, when the number of rows of the heat transfer tubes is increased as in the heat exchanger 1, the heat exchange amount can be increased without changing the area in the state of the front view of the heat exchanger 1, the interval between the fins 6, or other matters. When the number of rows of the heat transfer tubes is two, the heat exchange amount is increased about 1.5 times or more. Note that, the number of rows of the heat transfer tubes may be three or more. Still further, the area in the state of the front view of the heat exchanger 1, the interval between the fins 6, or other matters may be changed.

Further, the header (stacking-type header 2) is arranged only on one side of the heat exchanger 1. For example, when the heat exchanger 1 is arranged in a bent state along a plurality of side surfaces of the housing incorporating the heat exchanger 1 in order to increase the mounting volume of the heat exchanging unit, the end portion may be misaligned in each row of the heat transfer tubes because the curvature radius of the bent part differs depending on each row of the heat transfer tubes. When, as in the stacking-type header 2, the header (stacking-type header 2) is arranged only on one side of the heat exchanger 1, even when the end portion is misaligned in each row of the heat transfer tubes, only the end portions on one side are required to be aligned, which improves the degree of freedom in design, the production efficiency, and other matters as compared to the case where the headers (stacking-type header 2 and header 3) are arranged on both sides of the heat exchanger 1 as in the heat exchanger according to Embodiment 1. In particular, the heat exchanger 1 can be bent after the respective members of the heat exchanger 1 are joined to each other, which further improves the production efficiency.

Further, when the heat exchanger 1 acts as the condensor, the first heat transfer tube 4 is positioned on the windward side with respect to the second heat transfer tube 7. When the headers (stacking-type header 2 and header 3) are arranged on both sides of the heat exchanger 1 as in the heat exchanger according to Embodiment 1, it is difficult to provide a temperature difference in the refrigerant for each row of the heat transfer tubes to improve the condensor performance. In particular, when the first heat transfer tube 4 and the second heat transfer tube 7 are flat tubes, unlike a circular tube, the degree of freedom in bending is low, and hence it is difficult to realize providing the temperature difference in the refrigerant for each row of the heat transfer tubes by deforming the flow passage of the refrigerant. On the other hand, when the first heat transfer tube 4 and the second heat transfer tube 7 are connected to the stacking-type header 2 as in the heat exchanger 1, the temperature difference in the refrigerant is inevitably generated for each row of the heat transfer tubes, and obtaining the relationship that the refrigerant flow and the air stream are opposed to each other can be easily realized without deforming the flow passage of the refrigerant.

The present invention has been described above with reference to Embodiment 1 to Embodiment 3, but the present invention is not limited to those embodiments. For example, a part or all of the respective embodiments, the respective modified examples, and the like may be combined.

REFERENCE SIGNS LIST

1 heat exchanger 2 stacking-type header 2A refrigerant inflow port 2B refrigerant outflow port 2C refrigerant inflow port 2D refrigerant outflow port 2E refrigerant turn-back port 3 header 3A refrigerant inflow port 3B refrigerant outflow port 4 first heat transfer tube 5 retaining member 6 fin 7 second heat transfer tube 11 first plate-shaped unit 11A first outlet flow passage 11B second inlet flow passage 11C turn-back flow passage 12 second plate-shaped unit 12A distribution flow passage 12B joining flow passage 12*a* first inlet flow passage 12*b* branching flow passage 12*c* mixing flow passage 12*d* second outlet flow passage 21 first plate-shaped member 21A-21C flow passage 22 second plate-shaped member 22A, 22B flow passage 23, 23_1-23_3 third plate-shaped member 23A-23D, 23A_1-23A_3, 23D_1-23D_3 flow passage 23*a*, 23*b* end portion of through groove 23*c* straight-line part 23*d*, 23*e* end portion of straight-line part 23*f* opening port 23*g* first flow passage 23*h* second flow passage 23*i*, 23*j* connecting part 23*k*, 23*l* straight-line part 23*m* center of opening port 23*n* projecting portion 23*o*, 23*p* end portion of bottomed groove 23*q* through hole 24, 24_1-24_5 both-side clad member 24A-24C flow passage 25 plate-shaped member 25A, 25B flow passage 26 convex portion 27 concave portion 51 air-conditioning apparatus 52 compressor 53 four-way valve 54 heat source-side heat exchanger 55 expansion device 56 load-side heat exchanger 57 heat source-side fan 58 load-side fan 59 controller

The invention claimed is:

1. A stacking-type header, comprising:

a first plate-shaped unit having a plurality of first outlet flow passages formed therein; and a second plate-shaped unit being stacked on the first plate-shaped unit and having a first inlet flow passage formed therein and a distribution flow passage formed therein, the distribution flow passage being configured to distribute refrigerant, which passes through the first inlet flow passage to flow into the second plate-shaped unit, to the plurality of first outlet flow passages to cause the refrigerant to flow out from the second plate-shaped unit, wherein the distribution flow passage comprises a branching flow passage, which comprises an opening port configured to allow the refrigerant to flow thereinto;

a first flow passage communicating between the opening port and an end portion positioned on an upper side relative to the opening port; and a second flow passage communicating between the opening port and an end portion positioned on a lower side relative to the opening port, wherein a flow-passage resistance in the second flow passage is larger than a flow-passage resistance in the first flow passage, wherein a width of the second flow passage is smaller than a width of the first flow passage, wherein the second plate-shaped unit comprises at least one plate-shaped member having a third flow passage formed therein, the third flow passage passing through the at least one plate-shaped member in a stacking direction of the stacking-type header, wherein the branching flow passage is formed by closing a region of the third flow passage passing through the at least one plate-shaped member other than a refrigerant inflow region and a refrigerant outflow region by a member stacked adjacent to the at least one plate-shaped member, wherein the at least one plate-shaped member has a convex portion, which is specific to the at least one plate-shaped member, and wherein the convex portion is fit into the branching flow passage formed in the member stacked adjacent to the at least one plate-shaped member.

2. The stacking-type header of claim 1, wherein the second flow passage has a projecting portion projecting inward from the second flow passage.

3. The stacking-type header of claim 1, wherein a surface of the second flow passage is rougher than a surface of the first flow passage.

4. The stacking-type header of claim 1, wherein a depth of the second flow passage is smaller than a depth of the first flow passage.

5. The stacking-type header of claim 1, wherein a length of the second flow passage is larger than a length of the first flow passage.

6. The stacking-type header of claim 1, wherein the first flow passage communicates with the opening port from a lower side of the opening port, and wherein the second flow passage communicates with the opening port from an upper side of the opening port.

7. The stacking-type header of claim 1, wherein a bending angle of the second flow passage is larger than a bending angle of the first flow passage.

8. A heat exchanger, comprising the stacking-type header of claim 1; and a plurality of first heat transfer tubes connected to the plurality of first outlet flow passages, respectively.

9. An air-conditioning apparatus, comprising the heat exchanger of claim 8, wherein the distribution flow passage is configured to cause the refrigerant to flow out from the distribution flow passage toward the plurality of first outlet flow passages when the heat exchanger acts as an evaporator.

10. A stacking-type header, comprising:

a first plate-shaped unit having a plurality of first outlet flow passages formed therein; and a second plate-shaped unit being stacked on the first plate-shaped unit and having a first inlet flow passage formed therein and a distribution flow passage formed therein, the distribution flow passage being configured to distribute refrigerant, which passes through the first inlet flow passage to flow into the second plate-shaped unit, to the plurality of first outlet flow passages to cause the refrigerant to flow out from the second plate-shaped unit, wherein the distribution flow passage comprises a branching flow passage, which comprises an opening port configured to allow the refrigerant to flow thereinto;

a first flow passage communicating between the opening port and an end portion positioned on an upper side relative to the opening port; and a second flow passage communicating between the opening port and an end portion positioned on a lower side relative to the opening port, wherein a flow-passage resistance in the second flow passage is larger than a flow-passage resistance in the first flow passage, wherein a width of the second flow passage is smaller than a width of the first flow passage, wherein the branching flow passage comprises a first branching flow passage configured to cause the refrigerant to flow out from the branching flow passage to a side on which the first plate-shaped unit is present, and a second branching flow passage configured to cause the refrigerant to flow out from the branching flow passage to a side opposite to the side on which the first plate-shaped unit is present.

11. An air-conditioning apparatus comprising a heat exchanger, wherein the heat exchanger comprises a stacking-type header, which includes a first plate-shaped unit having a plurality of first outlet flow passages formed therein; and a second plate-shaped unit being stacked on the first plate-shaped unit and having a first inlet flow passage formed therein and a distribution flow passage formed therein, the distribution flow passage being configured to distribute refrigerant, which passes through the first inlet flow passage to flow into the second plate-shaped unit, to the plurality of first outlet flow passages to cause the refrigerant to flow out from the second plate-shaped unit; and a plurality of first heat transfer tubes connected to the plurality of first outlet flow passages, respectively, wherein the distribution flow passage comprises a branching flow passage, which includes an opening port configured to allow the refrigerant to flow thereinto;

a first flow passage communicating between the opening port and an end portion positioned on an upper side relative to the opening port; and a second flow passage communicating between the opening port and an end portion positioned on a lower side relative to the opening port, wherein a flow-passage resistance in the second flow passage is larger than a flow-passage resistance in the first flow passage, wherein a width of the second flow passage is smaller than a width of the first flow passage, wherein the first plate-shaped unit of the stacking-type header has a plurality of second inlet flow passages formed therein, into which the refrigerant passing through the plurality of first heat transfer tubes flows, wherein the second plate-shaped unit of the stacking-type header has a joining flow passage formed therein, the joining flow passage being configured to join together flows of the refrigerant, which passes through the plurality of second inlet flow passages to flow into the second plate-shaped unit, to cause the refrigerant to flow into a second outlet flow passage, wherein the heat exchanger comprises a plurality of second heat transfer tubes connected to the plurality of second inlet flow passages, respectively, wherein the distribution flow passage is configured to cause the refrigerant to flow out from the distribution flow passage toward the plurality of first outlet flow passages when the heat exchanger acts as an evaporator, and wherein the plurality of first heat transfer tubes are positioned on a windward side with respect to the plurality of second heat transfer tubes when the heat exchanger acts as a condenser.

* * * * *